US011699406B2

(12) United States Patent
Ma et al.

(10) Patent No.: US 11,699,406 B2
(45) Date of Patent: Jul. 11, 2023

(54) CONTROL METHOD OF E-INK SCREEN, AND DISPLAY CONTROL APPARATUS

(71) Applicants: Chongqing BOE Smart Electronics System Co., Ltd., Chongqing (CN); BOE TECHNOLOGY GROUP CO., LTD., Beijing (CN)

(72) Inventors: Senlei Ma, Beijing (CN); Lichun Chen, Beijing (CN); Bo Liu, Beijing (CN); Yunyan Xie, Beijing (CN); Qiangeng Cheng, Beijing (CN); Heng Zheng, Beijing (CN)

(73) Assignees: Chongqing BOE Smart Electronics System Co., Ltd., Chongqing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/610,663

(22) PCT Filed: Oct. 29, 2020

(86) PCT No.: PCT/CN2020/124949
§ 371 (c)(1),
(2) Date: Nov. 11, 2021

(87) PCT Pub. No.: WO2022/087988
PCT Pub. Date: May 5, 2022

(65) Prior Publication Data
US 2022/0319446 A1 Oct. 6, 2022

(51) Int. Cl.
*G09G 3/34* (2006.01)

(52) U.S. Cl.
CPC ..... *G09G 3/344* (2013.01); *G09G 2310/0254* (2013.01); *G09G 2310/0275* (2013.01);
(Continued)

(58) Field of Classification Search
None
See application file for complete search history.

(56) References Cited

U.S. PATENT DOCUMENTS

2009/0079676 A1 3/2009 Shirasaki et al.
2017/0025072 A1 1/2017 Lin et al.
(Continued)

FOREIGN PATENT DOCUMENTS

CN 101393368 A 3/2009
CN 110366747 A 10/2019
(Continued)

*Primary Examiner* — Matthew Yeung
(74) *Attorney, Agent, or Firm* — IP & T Group LLP

(57) ABSTRACT

A control method of an e-ink screen. The e-ink screen includes a plurality of pixels, at least one pixel includes first color charged particles and second color charged particles, and the first color charged particles and the second color charged particles are same in electrical property. The control method of the e-ink screen includes: inputting a first color driving signal to pixels expected to display a first color in the e-ink screen. The first color driving signal includes a plurality of sub-signals corresponding to a plurality of driving stages. The plurality of sub-signals include a first color imaging sub-signal and a particle separation sub-signal. The particle separation sub-signal is configured to drive the first color charged particles and the second color charged particles in the at least one pixel to move, and to separate the first color charged particles from the second color charged particles.

14 Claims, 7 Drawing Sheets

(52) U.S. Cl.
CPC . *G09G 2310/06* (2013.01); *G09G 2320/0238* (2013.01); *G09G 2320/0242* (2013.01); *G09G 2320/043* (2013.01)

(56) References Cited

U.S. PATENT DOCUMENTS

| | | | | |
|---|---|---|---|---|
| 2018/0152823 | A1* | 5/2018 | Kovács | G09G 3/3618 |
| 2018/0307115 | A1 | 10/2018 | Chan et al. | |
| 2019/0331979 | A1* | 10/2019 | Takada | G02F 1/167 |
| 2021/0383764 | A1* | 12/2021 | Lin | G09G 3/344 |

FOREIGN PATENT DOCUMENTS

| | | | |
|---|---|---|---|
| CN | 111508442 | A | 8/2020 |
| WO | 2018/200252 | A1 | 11/2018 |

* cited by examiner

CONTROL METHOD OF E-INK SCREEN, AND DISPLAY CONTROL APPARATUS

CROSS-REFERENCE TO RELATED APPLICATION

This application is a national phase entry under 35 USC 371 of International Patent Application No. PCT/CN2020/124949, filed on Oct. 29, 2020, which is incorporated herein by reference in its entirety.

TECHNICAL FIELD

The present disclosure relates to the field of display technologies, and in particular, to a control method of an e-ink screen, a display control apparatus, and an e-ink display apparatus.

BACKGROUND

Like a traditional ink, an e-ink may be printed onto surfaces of many materials (e.g., plastic, polyester film, paper, and cloth). A difference is that the e-ink may change a displayable color under an action of an electric field, so that an e-ink display apparatus made of the e-ink may display an image.

Compared with other types of displays, such as a liquid crystal display (LCD) and an organic electroluminescence display (OLED), the e-ink display apparatus has advantages of low power consumption, legibility, being easy to manufacture at a low cost, or the like.

SUMMARY

In an aspect, a control method of an e-ink screen is provided. The e-ink screen includes a plurality of pixels, and at least one pixel includes first color charged particles and second color charged particles. The first color charged particles and the second color charged particles are same in electrical property. The control method of the e-ink screen includes: inputting a first color driving signal to pixels expected to display a first color in the e-ink screen.

The first color driving signal includes a plurality of sub-signals corresponding to a plurality of driving stages. The plurality of sub-signals include a first color imaging sub-signal and a particle separation sub-signal, and at least one driving stage corresponding to the particle separation sub-signal is at least one driving stage before a driving stage corresponding to the first color imaging sub-signal. The first color imaging sub-signal is configured to drive the first color charged particles in the at least one pixel to move towards a side proximate to a display surface of the e-ink screen, so that the pixels expected to display the first color display the first color. The particle separation sub-signal is configured to drive the first color charged particles and the second color charged particles in the at least one pixel to move, and to separate the first color charged particles from the second color charged particles.

In some embodiments, the particle separation sub-signal includes a first particle separation sub-signal, and a driving stage corresponding to the first particle separation sub-signal is a driving stage before the driving stage corresponding to the first color imaging sub-signal. The first particle separation sub-signal is a first color push-down sub-signal configured to drive the first color charged particles and the second color charged particles to move towards a side away from the display surface of the e-ink screen and separate the first color charged particles from the second color charged particles.

In some embodiments, the particle separation sub-signal includes a second particle separation sub-signal, and a driving stage corresponding to the second particle separation sub-signal is a driving stage before the driving stage corresponding to the first color imaging sub-signal. The second particle separation sub-signal is a first color first dither sub-signal including first levels and second levels that are alternately arranged in a time sequence. The second particle separation sub-signal is configured to drive the first color charged particles and the second color charged particles to wobble. A first level in the first levels is configured to drive the first color charged particles and the second color charged particles to move towards the side proximate to the display surface of the e-ink screen. A second level in the second levels is configured to drive the first color charged particles and the second color charged particles to move towards a side away from the display surface of the e-ink screen. A duration of the first level is less than a duration of the second level.

In some embodiments, the particle separation sub-signal includes a first particle separation sub-signal and a second particle separation sub-signal. A driving stage corresponding to the first particle separation sub-signal precedes the driving stage corresponding to the first color imaging sub-signal, and a driving stage corresponding to the second particle separation sub-signal precedes the driving stage corresponding to the first particle separation sub-signal. The first particle separation sub-signal is a first color push-down signal configured to drive the first color charged particles and the second color charged particles to move towards a side away from the display surface of the e-ink screen and separate the first color charged particles from the second color charged particles.

The second particle separation sub-signal is a first color first dither sub-signal including first levels and second levels that are alternately arranged in a time sequence. The second particle separation sub-signal is configured to drive the first color charged particles and the second color charged particles to wobble. A first level in the first levels is configured to drive the first color charged particles and the second color charged particles to move towards the side proximate to the display surface of the e-ink screen. A second level in the second levels is configured to drive the first color charged particles and the second color charged particles to move towards the side away from the display surface of the e-ink screen. A duration of the first level is less than a duration of the second level.

In some embodiments, the plurality of sub-signals included in the first color driving signal further include a first color balance sub-signal, and a driving stage corresponding to the first color balance sub-signal is a first driving stage in the plurality of driving stages. The first color balance sub-signal is configured to make a position of the first color charged particles at an initial position. The initial position is a position of the first color charged particles in a case where the pixels expected to display the first color are not driven by the first color driving signal.

In some embodiments, the first color balance sub-signal includes a reference level, a third level, a fourth level and a reference level that are sequentially arranged. A level polarity of the third level is opposite to a level polarity of the first color imaging sub-signal. In a case where the particle separation sub-signal includes the first particle separation sub-signal, a level polarity of the fourth level is opposite to a level polarity of the first particle separation sub-signal. In a case where the particle separation sub-signal includes the second particle separation sub-signal, the second particle separation sub-signal includes first levels and second levels that are alternately arranged in a time sequence, and the level polarity of the fourth level is opposite to a level polarity of the second level.

In some embodiments, the first color driving signal includes sub-signals corresponding to at least seven driving stages. Sub-signals corresponding to a first driving stage to a seventh driving stage included in the first color driving signal are sequentially a first color balance sub-signal, a first color second dither sub-signal, a first color third dither sub-signal, a first color first dither sub-signal, a first color push-down sub-signal, the first color imaging sub-signal, and an electric field cancellation sub-signal.

The first color balance sub-signal is configured to make a position of the first color charged particles at an initial position. The initial position is a position of the first color charged particles in a case where the pixels expected to display the first color are not driven by the first color driving signal. The first color second dither sub-signal is configured to drive the first color charged particles to wobble. The first color third dither sub-signal is configured to drive the first color charged particles to continue to wobble. The first color first dither sub-signal is configured to drive the first color charged particles and the second color charged particles to wobble and separate the first color charged particles from the second color charged particles. The first color push-down sub-signal is configured to drive the first color charged particles and the second color charged particles to move towards a side away from the display surface of the e-ink screen and separate the first color charged particles from the second color charged particles. The first color imaging sub-signal is configured to drive the first color charged particles in the at least one pixel to move towards the side proximate to the display surface of the e-ink screen, so that the pixels expected to display the first color display the first color. The electric field cancellation sub-signal is configured to cancel driving to the first color charged particles.

In some embodiments, the control method further includes: inputting a second color driving signal to pixels expected to display a second color in the e-ink screen. The second color driving signal includes a plurality of sub-signals corresponding to the plurality of driving stages. In a case where the first color driving signal includes the second particle separation sub-signal, the second color driving signal includes a second color first dither sub-signal. A driving stage corresponding to the second color first dither sub-signal and a driving stage corresponding to the second particle separation sub-signal are a same driving stage.

The second color first dither sub-signal includes fifth levels and sixth levels that are alternately arranged in a time sequence. The second color first dither sub-signal is configured to drive the first color charged particles and the second color charged particles to wobble. A fifth level in the fifth levels is configured to drive the first color charged particles and the second color charged particles to move towards the side proximate to the display surface of the e-ink screen. A sixth level in the sixth levels is configured to drive the first color charged particles and the second color charged particles to move towards a side away from the display surface of the e-ink screen. A duration of the fifth level is equal to the duration of the first level, and a duration of the sixth level is equal to the duration of the second level.

In some embodiments, the second color driving signal includes sub-signals corresponding to at least seven driving stages. Sub-signals corresponding to a first driving stage to a seventh driving stage included in the second color driving signal are sequentially a second color inversion sub-signal, a second color balance sub-signal, a second color second dither sub-signal, the second color first dither sub-signal, a second color pre-imaging sub-signal, a second color push-up sub-signal, and a second color imaging sub-signal.

The second color inversion sub-signal is configured to drive the second color charged particles to invert. The second color balance sub-signal is configured to make a position of the second color charged particles at an initial position. The initial position is a position of the second color charged particles in a case where the pixels expected to display the second color are not driven by the second color driving signal. The second color second dither sub-signal is configured to drive the second color charged particles to wobble. The second color first dither sub-signal is configured to drive the second color charged particles to continue to wobble. The second color pre-imaging sub-signal is configured to drive the second color charged particles in the at least one pixel to move towards the side proximate to the display surface of the e-ink screen. The second color push-up sub-signal is configured to drive the second color charged particles in the at least one pixel to move towards the side proximate to the display surface of the e-ink screen. The second color imaging sub-signal is configured to drive the second color charged particles in the at least one pixel to move towards the side proximate to the display surface of the e-ink screen, so that the pixels expected to display the second color display the second color.

In some embodiments, the at least one pixel further includes third color charged particles, and the third color charged particles are opposite to the first color charged particles in electrical property. The control method further includes: inputting a third color driving signal to pixels expected to display a third color in the e-ink screen.

In a case where the first color driving signal includes the second particle separation sub-signal, the third color driving signal includes a third color first dither sub-signal. A driving stage corresponding to the third color first dither sub-signal and a driving stage corresponding to the second particle separation sub-signal are a same driving stage. The third color first dither sub-signal includes seventh levels and reference levels that are alternately arranged in a time sequence. The third color first dither sub-signal is configured to drive the third color charged particles to wobble. A seventh level in the seventh levels is configured to drive the third color charged particles to move towards the side proximate to the display surface of the e-ink screen. A reference level in the reference levels is configured to cancel driving to the third color charged particles. A duration of the seventh level is equal to the duration of the first level, and a duration of the reference level is equal to the duration of the second level.

In some embodiments, the third color driving signal includes sub-signals corresponding to at least seven driving stages. Sub-signals corresponding to a first driving stage to a seventh driving stage included in the third color driving signal are sequentially a third color balance sub-signal, a third color third dither sub-signal, a third color second dither sub-signal, the third color first dither sub-signal, an electric field cancellation sub-signal, a third color imaging sub-signal, and an electric field cancellation sub-signal.

The third color balance sub-signal is configured to make a position of the third color charged particles at an initial position. The initial position is a position of the third color charged particles in a case where the pixels expected to display the third color are not driven by the third color driving signal. The third color third dither sub-signal is configured to drive the third color charged particles to wobble. The third color second dither sub-signal is configured to drive the third color charged particles to continue to wobble. The third color first dither sub-signal is configured to drive the third color charged particles to continue to wobble. The electric field cancellation sub-signal is configured to cancel driving to the third color charged particles. The third color imaging sub-signal is configured to drive the third color charged particles in the at least one pixel to move towards the side proximate to the display surface of the e-ink screen, so that the pixels expected to display the third color display the third color. The electric field cancellation sub-signal is configured to cancel driving to the third color charged particles.

In some embodiments, in a case where colors of an image to be displayed include the first color, a second color, and a third color, inputting the first color driving signal to the pixels expected to display the first color in the e-ink screen, inputting a second color driving signal to pixels expected to display a second color in the e-ink screen, and inputting a third color driving signal to pixels expected to display a third color in the e-ink screen, includes: sequentially scanning pixels in rows in the e-ink screen at an I-th driving stage of displaying the image to be displayed; and inputting a sub-signal of the first color driving signal corresponding to the I-th driving stage to pixels expected to display the first color in pixels in each scanned row, inputting a sub-signal of the second color driving signal corresponding to the I-th driving stage to pixels expected to display the second color in pixels in each scanned row, and inputting a sub-signal of the third color driving signal corresponding to the I-th driving stage to pixels expected to display the third color in pixels in each scanned row. I is greater than or equal to 1, and the first color driving signal, the second color driving signal and the third color driving signal have a same number of driving stages corresponding thereto.

In some embodiments, in a case where each pixel includes the first color charged particles, the second color charged particles, and the third color charged particles, inputting the first color driving signal to the pixels expected to display the first color in the e-ink screen, inputting the second color driving signal to the pixels expected to display the second color in the e-ink screen, and inputting the third color driving signal to the pixels expected to display the third color in the e-ink screen, includes: according to a stored first color waveform file, inputting the first color driving signal corresponding to the first color waveform file to the pixels expected to display the first color, the first color waveform file recording a waveform of the first color driving signal; according to a stored second color waveform file, inputting the second color driving signal corresponding to the second color waveform file to the pixels expected to display the second color, the second color waveform file recording a waveform of the second color driving signal; and according to a stored third color waveform file, inputting the third color driving signal corresponding to the third color waveform file to the pixels expected to display the third color, the third color waveform file recording a waveform of the third color driving signal.

In another aspect, a display control apparatus is provided. The display control apparatus includes a source driver, at least one memory, and at least one processor. The at least one memory is configured to store a first color waveform file, and the first color waveform file records a waveform of a first color driving signal. The at least one processor is configured to control the source driver to input the first color driving signal to pixels expected to display a first color in an e-ink screen according to the first color waveform file stored in the at least one memory.

The first color driving signal includes a plurality of sub-signals corresponding to a plurality of driving stages, and the plurality of sub-signals include a first color imaging sub-signal and a particle separation sub-signal. The particle separation sub-signal is located at at least one driving stage before a driving stage where the first color imaging sub-signal is located. The first color imaging sub-signal is configured to drive first color charged particles in a pixel to move towards a side proximate to a display surface of the e-ink screen, so that the pixels expected to display the first color display the first color. The particle separation sub-signal is configured to drive the first color charged particles and second color charged particles in the pixel to move, and to separate the first color charged particles from the second color charged particles.

In some embodiments, the particle separation sub-signal includes a first particle separation sub-signal, and a driving stage corresponding to the first particle separation sub-signal is a driving stage before a driving stage corresponding to the first color imaging sub-signal. The first particle separation sub-signal is a first color push-down sub-signal configured to drive the first color charged particles and the second color charged particles to move towards a side away from the display surface of the e-ink screen and separate the first color charged particles from the second color charged particles.

In some embodiments, the particle separation sub-signal includes a second particle separation sub-signal, and a driving stage corresponding to the second particle separation sub-signal is a driving stage before a driving stage corresponding to the first color imaging sub-signal. The second particle separation sub-signal is a first color first dither sub-signal including first levels and second levels that are alternately arranged in a time sequence.

The second particle separation sub-signal is configured to drive the first color charged particles and the second color charged particles to wobble. A first level in the first levels is configured to drive the first color charged particles and the second color charged particles to move towards the side proximate to the display surface of the e-ink screen. A second level in the second levels is configured to drive the first color charged particles and the second color charged particles to move towards a side away from the display surface of the e-ink screen. A duration of the first level is less than a duration of the second level.

In some embodiments, the particle separation sub-signal includes a first particle separation sub-signal and a second particle separation sub-signal. A driving stage corresponding to the first particle separation sub-signal precedes a driving stage corresponding to the first color imaging sub-signal, and a driving stage corresponding to the second particle separation sub-signal precedes the driving stage corresponding to the first particle separation sub-signal.

The first particle separation sub-signal is a first color push-down signal configured to drive the first color charged particles and the second color charged particles to move towards a side away from the display surface of the e-ink screen and separate the first color charged particles from the second color charged particles.

The second particle separation sub-signal is a first color first dither sub-signal including first levels and second levels that are alternately arranged in a time sequence. The second particle separation sub-signal is configured to drive the first color charged particles and the second color charged particles to wobble. A first level in the first levels is configured to drive the first color charged particles and the second color charged particles to move towards the side proximate to the display surface of the e-ink screen. A second level in the second levels is configured to drive the first color charged particles and the second color charged particles to move towards the side away from the display surface of the e-ink screen. A duration of the first level is less than a duration of the second level.

In some embodiments, the at least one processor is further configured to store a second color waveform file and a third color waveform file. The second color waveform file records a waveform of a second color driving signal, and the third color waveform file records a waveform of a third color driving signal. The at least one processor is further configured to: control the source driver to output the second color driving signal corresponding to the second color waveform file to pixels expected to display a second color according to the second color waveform file stored in the at least one memory; and control the source driver to output the third color driving signal corresponding to the third color waveform file to pixels expected to display a third color according to the third color waveform file stored in the at least one memory.

In yet another aspect, an e-ink display apparatus is provided. The e-ink display apparatus includes an e-ink screen and a display control apparatus coupled to the e-ink screen. The e-ink screen includes a plurality of pixels, at least one pixel includes first color charged particles and second color charged particles. The first color charged particles and the second color charged particles are same in electrical property. The display control apparatus is the display control apparatus as described above.

In some embodiments, a charge amount of the first color charged particles is greater than a charge amount of the second color charged particles.

In yet another aspect, a non-transitory computer-readable storage medium storing computer program instructions is provided. When the computer program instructions run on an e-ink display apparatus, the e-ink display apparatus executes the control method of the e-ink screen in any one of the above embodiments.

BRIEF DESCRIPTION OF THE DRAWINGS

In order to describe technical solutions in the present disclosure more clearly, accompanying drawings to be used in some embodiments of the present disclosure will be introduced briefly below. Obviously, the accompanying drawings to be described below are merely accompanying drawings of some embodiments of the present disclosure, and a person of ordinary skill in the art may obtain other drawings according to these drawings. In addition, the accompanying drawings to be described below may be regarded as schematic diagrams, but are not limitations on an actual size of a product, an actual process of a method, and an actual timing of a signal involved in the embodiments of the present disclosure.

DETAILED DESCRIPTION

Figure 1:
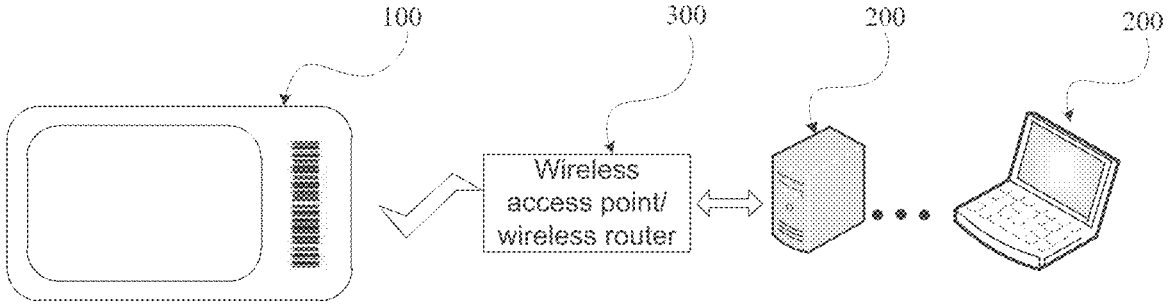
FIG. 1 is a structural diagram of a system architecture using an e-ink display apparatus, in accordance with some embodiments of the present disclosure.

Technical solutions in some embodiments of the present disclosure will be described clearly and completely with reference to the accompanying drawings below. Obviously, the described embodiments are merely some but not all embodiments of the present disclosure. All other embodiments obtained by a person of ordinary skill in the art on a basis of the embodiments of the present disclosure shall be included in the protection scope of the present disclosure.

Unless the context requires otherwise, throughout the description and the claims, the term "comprise" and other forms thereof such as the third-person singular form "comprises" and the present participle form "comprising" are construed as an open and inclusive meaning, i.e., "including, but not limited to". In the description of the specification, the terms such as "one embodiment", "some embodiments", "exemplary embodiments", "an example", "specific example" or "some examples" are intended to indicate that specific features, structures, materials or characteristics related to the embodiment(s) or example(s) are included in at least one embodiment or example of the present disclosure. Schematic representations of the above terms do not necessarily refer to the same embodiment(s) or example(s). In addition, the specific features, structures, materials, or characteristics may be included in any one or more embodiments or examples in any suitable manner.

Below, the terms such as "first" and "second" are only used for descriptive purposes, and are not to be construed as indicating or implying the relative importance or implicitly indicating the number of indicated technical features. Thus, a feature defined with "first" or "second" may explicitly or implicitly include one or more of the features. In the description of the embodiments of the present disclosure, the term "a plurality of/the plurality of" means two or more unless otherwise specified.

In the description of some embodiments, the terms "coupled" and "connected" and their derivatives may be used. For example, the term "connected" may be used in the description of some embodiments to indicate that two or more components are in direct physical or electrical contact with each other. For another example, the term "coupled" may be used in the description of some embodiments to indicate that two or more components are in direct physical or electrical contact with each other. However, the term "coupled" or "communicatively coupled" may also mean that two or more components are not in direct contact with each other, but still cooperate or interact with each other. The embodiments disclosed herein are not necessarily limited to the contents herein.

As used herein, the term "if" is optionally construed as "when" or "in a case where" or "in response to determining" or "in response to detecting", depending on the context. Similarly, the phrase "if it is determined . . . " or "if [a stated condition or event] is detected" is optionally construed as "in a case where it is determined . . . " or "in response to determining . . . " or "in a case where [the stated condition or event] is detected" or "in response to detecting [the stated condition or event]", depending on the context.

The use of "applicable to" or "configured to" herein means an open and inclusive expression, which does not exclude devices that are applicable to or configured to perform additional tasks or steps.

In addition, the use of "based on" is meant to be open and inclusive, in that a process, step, calculation or other action "based on" one or more of the stated conditions or values may, in practice, be based on additional conditions or values exceeding those stated.

The term such as "about", "approximately" or "substantially" as used herein includes a stated value and an average value within an acceptable range of deviation of a particular value determined by a person of ordinary skill in the art, considering measurement in question and errors associated with measurement of a particular quantity (i.e., limitations of a measurement system).

An e-ink display apparatus uses an electrophoretic display technology to realize display. The e-ink display apparatus has many advantages, and is therefore widely popular among consumers. The e-ink display apparatus also has some disadvantages, such as a problem of imaging deviation in case of too long refreshing time and too long using time. In an example where the e-ink display apparatus may display a black image, a white image and a red image, after half a year of use, the e-ink display apparatus may exhibit an imaging deviation, which is mainly indicated as red when the black image is displayed (i.e., a phenomenon of reddish black), thereby affecting display quality and reducing service life. The inventors of the present disclosure have found through research that one of reasons for the problem of imaging deviation is that when the e-ink display apparatus is used for a long time, particle activity is decreased, so that black particles cannot be separated from red particles under a same voltage drive, resulting in the phenomenon of reddish black.

In order to solve this problem, referring to FIG. 1, some embodiments of the present disclosure provide a system architecture using an e-ink display apparatus. The system architecture includes the e-ink display apparatus 100 and a communication peer device 200, and the two may be connected in communication. The communication peer device 200 is configured to control an image displayed on the e-ink display apparatus 100. In some embodiments, the e-ink display apparatus 100 may establish a connection with the communication peer device 200 through wireless communication (e.g., Wi-Fi or Bluetooth). For example, the system architecture further includes a wireless router or a wireless access point 300. The communication peer device 200 is connected to the wireless router or the wireless access point (AP) 300 through wireless communication or wired communication. The e-ink display apparatus 100 establishes a connection with the wireless router or the wireless access point 300 through wireless communication, and thus is in communication connection with the communication peer device 200. Of course, this embodiment is not limited to this communication connection. For example, the communication peer device 200 and the e-ink display apparatus 100 may also establish a connection through wired communication.

The e-ink display apparatus 100 may be applied to various scenes. For example, the e-ink display apparatus 100 may be an electronic reader, a smart tag (also referred to as an electronic tag), an electronic timepiece (e.g., electronic watch), a thermometer, a bus stop board, or a fuel price board of a gas station. The smart tag may include an electronic price tag that may be placed on a goods shelf in a supermarket, a convenience store, or a pharmacy, a luggage tag, and a medicine tag on a medicine package.

Figure 2:
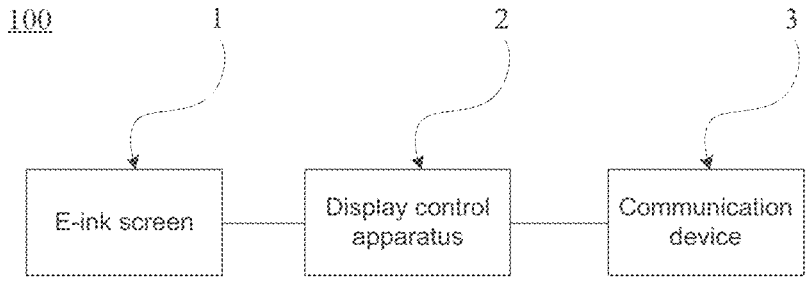
FIG. 2 is a structural diagram of an e-ink display apparatus, in accordance with some embodiments of the present disclosure.

Referring to FIG. 2, the e-ink display apparatus 100 may include an e-ink screen 1, a display control apparatus 2 and a communication device 3. The e-ink screen 1 and the communication device 3 both are connected to the display control apparatus 2.

Figure 3:
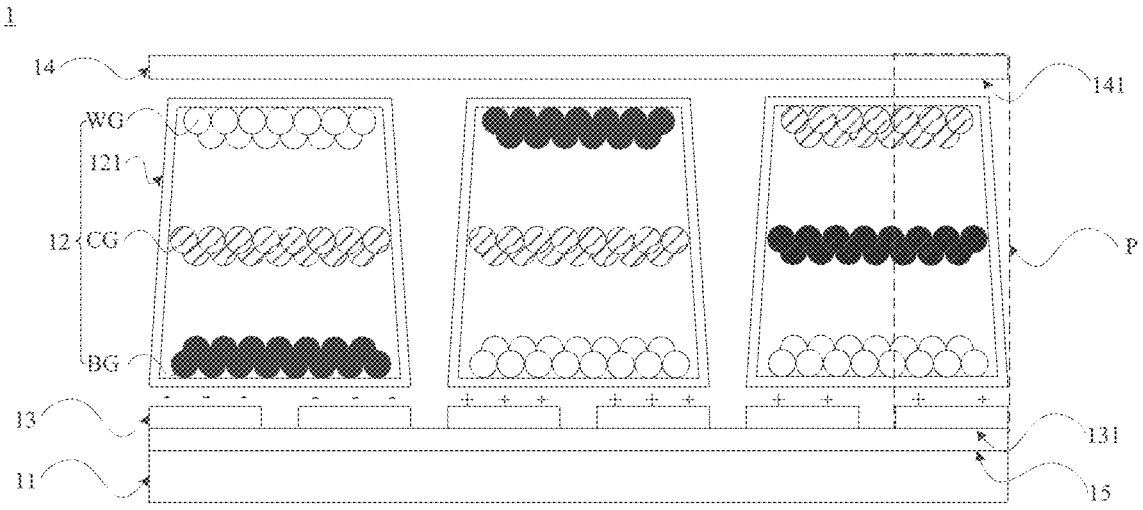
FIG. 3 is a structural diagram of an e-ink screen, in accordance with some embodiments of the present disclosure.

Referring to FIG. 3, in some embodiments, the e-ink screen 1 includes a substrate 11, an e-ink film (i.e., front panel liner (FPL)) 12 disposed on the substrate 11, a first electrode layer 13 and a second electrode layer 14. The first electrode layer 13 and the second electrode layer 14 are disposed on two sides of the e-ink film 12 in a thickness direction of the substrate 11, and the first electrode layer 13 is closer to the substrate 11 than the second electrode layer 14. Generally, the second electrode layer 14 is closer to a display surface of the e-ink screen 1 than the first electrode layer 13. The e-ink film 12 includes a plurality of microstructures 121, such as microcups or microcapsules. Each microstructure 121 includes a transparent liquid and a plurality of types of charged particles. By supplying power to the first electrode layer 13 and the second electrode layer 14, an electric field formed between the two is able to drive the charged particles in each microstructure 121 to move, so as to control the type of charged particles suspended at positions (i.e., a top of the microstructure 121 in FIG. 3) proximate to the display surface in each microstructure 121, thereby controlling a color presented by each microstructure 121, so that the e-ink screen 1 is able to display an image.

In some embodiments, among the plurality of types of charged particles included in the e-ink film 12, there may be two types of charged particles that have different colors and are same in electrical property (i.e., have charges of a same electrical property), and the two types of charged particles have different charge amounts. Or, among the plurality of types of charged particles included in the e-ink film 12, there may be two types of charged particles that have different colors and are different in electrical property (i.e., have charges of opposite electrical properties), and the two types of charged particles have a same or substantially same charge amount. Or, among the plurality of types of charged particles included in the e-ink film 12, there may be three types of charged particles that have different colors and are not completely same in electrical property, and two of the three types of charged particles are same in electrical property. For example, the two types of charged particles are positively charged, and the two types of charged particles have different charge amounts. A third type of charged particles are opposite to the two types of charged particles in electrical property, e.g., are negatively charged, and the third type of charged particles and one of the two types of charged particles have a same or substantially same charge amount.

For example, the plurality of types of charged particles included in the e-ink film 12 may include first color charged particles, second color charged particles, and third color charged particles. The first color charged particle and the second color charged particle are same in electrical property, and the first color charged particle and the third color charged particle are opposite in electrical property. A charge amount of the first color charged particles is greater than a charge amount of the second color charged particles, and a charge amount of the third color charged particles is same or substantially same as the charge amount of the first color charged particles. For example, the e-ink film 12 includes white charged particles WG, black charged particles BG, and color charged particles CG (e.g., red charged particles). The white charged particles WG may be negatively charged, and the black charged particles BG and the color charged particles CG may be positively charged. A charge amount of the black charged particles BG is same as or substantially same as a charge amount of the white charged particles WG, e.g., both are 11 V to 15 V. The charge amount of the black charged particles BG is greater than a charge amount of the color charged particles CG, e.g., the charge amount of the color charged particles CG is 4 V to 7 V. In this way, the black charged particle BG is regarded as the first color charged particle, the color charged particle CG is regarded as the second color charged particle, and the white charged particle WG is regarded as the third color charged particle. For another example, the e-ink film 12 includes white charged particles WG, black charged particles BG, and color charged particles CG. The color charged particles CG may be negatively charged, and one of the white charged particles WG and the black charged particles BG (e.g., the white charged particles WG) may be negatively charged, and another one (e.g., the black charged particles BG) is positively charged. A charge amount of the white charged particles WG is same as or substantially same as a charge amount of the black charged particles BG, and a charge amount of the color charged particles CG is less than the charge amount of the white charged particles WG or the charge amount of the black charged particles BG. Therefore, the color charged particle CG is regarded as the second color charged particle, the one (the white charged particle WG) that is same as the color charged particle CG in electrical property is regarded as the first color charged particle, and the one (the black charged particle BG) that is opposite to the color charged particle CG in electrical property is regarded as the third color charged particle.

Referring to FIG. 3, the e-ink film 12, the first electrode layer 13 and the second electrode layer 14 in the e-ink screen 1 may constitute a plurality of pixels P. For example, the plurality of pixels P may be arranged in an array. That is, the e-ink screen includes pixels P of S rows multiplied by Q columns (S rows*Q columns), S is greater than or equal to 2 (S≥2), and Q is greater than or equal to 2 (Q≥2). Accordingly, the first electrode layer 13 may include a plurality of first electrodes (also referred to as pixel electrodes) 131 arranged at intervals, the second electrode layer 14 may include a plurality of second electrodes (also referred to as common electrodes) 141 arranged opposite to the plurality of first electrodes 131. The plurality of second electrodes 141 may be electrically connected to each other. For example, the second electrode layer 14 may be a planar electrode layer, and the planar electrode layer only includes a closed contour line. For example, one pixel P may include one first electrode 131 and one or more microstructures 121 (e.g., one microstructure 121). Or, as shown in FIG. 3, one microstructure 121 is distributed in two adjacent pixels P.

In this way, the display control apparatus 2 may apply a voltage signal (may be referred to as a COM signal, and a voltage value thereof may be expressed by CM) to the second electrode layer 14, and may apply a corresponding data driving signal to the first electrode 131 included in each pixel P according to pixel data of the pixel P in a process of refreshing an image displayed on the e-ink screen 1. The data driving signal is a signal that changes within a range defined by a high voltage value (i.e., higher than the voltage value of the COM signal, which may be expressed by HI) and a low voltage value (i.e., lower than the voltage value of the COM signal, which may be expressed by LO). For example, if the pixel data of the pixel P is first color pixel data, a first color driving signal is applied to the first electrode 131 in this pixel P, so that first color charged particles in this pixel P are suspended at positions proximate to the display surface after an image refreshing is finished, and thus this pixel P displays a first color. If the pixel data of the pixel P is second color pixel data, a second color driving signal is applied to the first electrode 131 in this pixel P, so that second color charged particles in this pixel P are suspended at positions proximate to the display surface after an image refreshing is finished, and thus this pixel P displays a second color. If the pixel data of the pixel P is third color pixel data, a third color driving signal is applied to the first electrode 131 in this pixel P, so that third color charged particles in this pixel P are suspended at positions proximate to the display surface after an image refreshing is finished, and thus this pixel P displays a third color.

Figure 4:
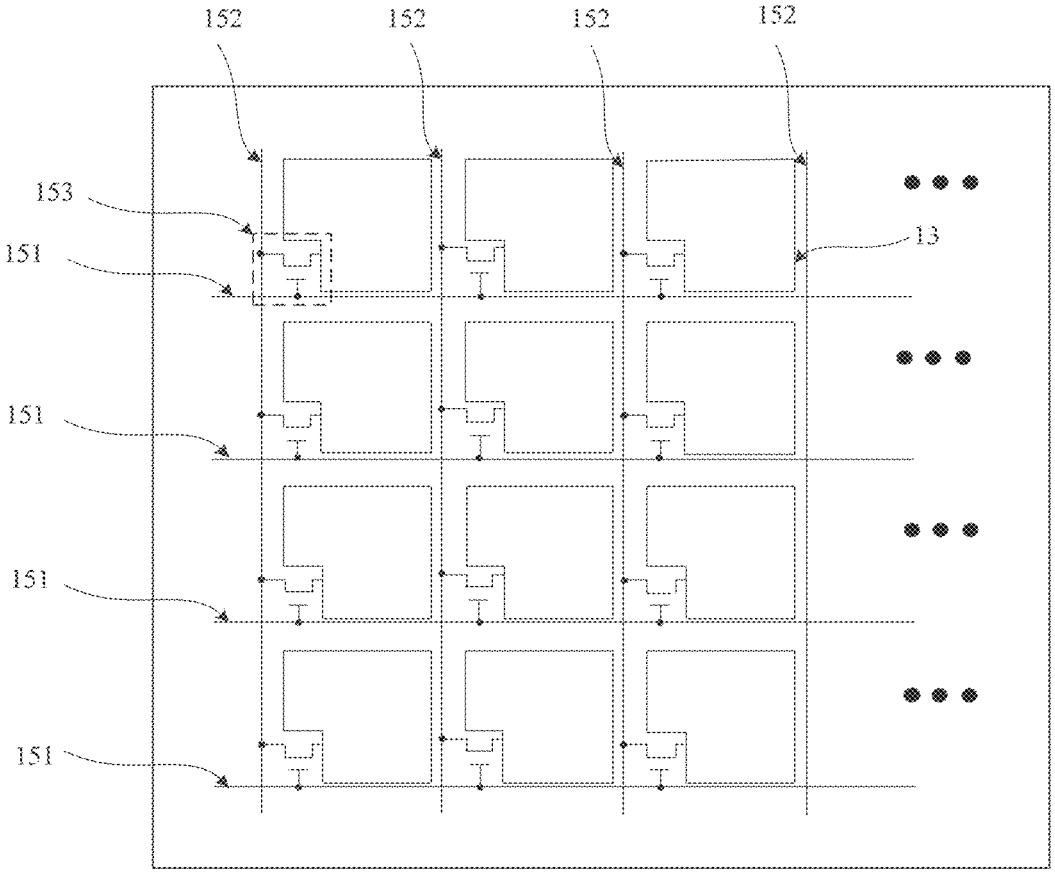
FIG. 4 is a structural diagram showing a connection of a pixel driving circuit and pixel electrodes, in accordance with some embodiments of the present disclosure.

In some embodiments, referring to FIG. 3, the e-ink screen 1 may further include a pixel driving circuit 15 disposed on the substrate 11 to apply a data driving signals to the first electrodes 131 in the first electrode layer 13, respectively. Referring to FIG. 4, the pixel driving circuit 15 may include a plurality of gate lines 151 and a plurality of data lines 152. The plurality of gate lines GL and the plurality of data lines DL are arranged crosswise, e.g., arranged perpendicular to each other. The pixel driving circuit 15 may further include switch devices 153 connected to the gate lines GL and the data lines DL that are arranged crosswise, and the switch devices 153 may be, for example, thin film transistors (TFTs). The display control apparatus 2 is connected to the plurality of gate lines 151 to input scan signals to the plurality of gate lines 151, so as to control gating of the pixels P in the rows connected to the plurality of gate lines 151. For example, the display control apparatus 2 may scan the pixels P in the rows row by row. That is, the scan signals are input to the plurality of gate lines 151 row by row in an order from the gate line in a first row to the gate line in a last row, so that the switch devices 153 connected to the scanned gate lines 151 are in a turn-on state. The display control apparatus 2 is connected to the plurality of data lines 152 to input the data driving signals to the first electrodes 131 in the pixels P in the rows that are gated (scanned), so as to make respective pixels P exhibit corresponding colors under an action of the electric field. For example, CM is 0 V, HI is 15 V, and LO is −15 V. In this case, a 0 V signal is supplied to the second electrode layer, and the data driving signals in a range of −15 V to 15 V are supplied to the first electrodes 131, so as to control a magnitude of the electric field where the pixels P are located.

The e-ink screen 1 has bistable characteristics, and even if the electric field is cancelled, a last refreshed image may stay on the e-ink screen 1. Therefore, the e-ink screen 1 is not required to be continuously powered to maintain an image. In this way, the e-ink display apparatus 100 may realize low power consumption.

Figure 5:
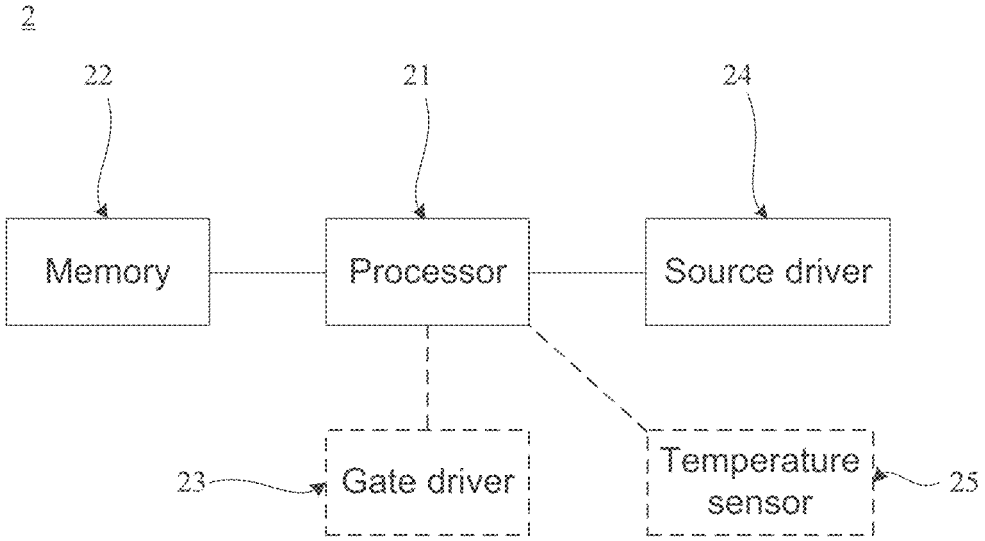
FIG. 5 is a structural diagram of a display control apparatus, in accordance with some embodiments of the present disclosure.

In some embodiments, referring to FIG. 5, the display control apparatus 2 included in the e-ink display apparatus 100 includes at least one processor 21, at least one memory 22, a gate driver 23, and a source driver 24.

The gate driver 23, which may also be referred to as a gate driving circuit, is configured to output the scan signals to the e-ink screen 1 under a control of the at least one processor 21, so as to control the gating of the pixels in the rows. The gate driver 23 may be disposed in the display control apparatus 2, or may be disposed in the e-ink screen 1, which is not limited in the embodiments. The gate driver 23 disposed in the display control apparatus 2 is taken as an example.

The source driver 24, which may also be referred to as a source driving circuit, is configured to output the data driving signals to the e-ink screen 1 under the control of the at least one processor 21, so as to control colors displayed by respective pixels.

For example, the gate driver 23 and/or the source driver 24 may send a BUSY signal (busy status signal) to the processor 21 to inform the processor 21 of a state of itself (the gate driver 23 and/or the source driver 24). The processor 21 may determine whether to send a command or data to the gate driver 23 and/or the source driver 24 according to the BUSY signal. The processor 21 send CLK (clock) signals to the gate driver 23 and the source driver 24 to provide the gate driver 23 and the source driver 24 with clocks required for their operations. In addition, the processor 21 may also send direct current (DC) signals to the gate driver 23 and the source driver 24 to inform the gate driver 23 and/or the source driver 24 whether a command or data is sent next. The source driver 24 may include a plurality of source driving sub-circuits. The processor 21 may send a chip select (CS) signal to one of the plurality of source driving sub-circuits to select the one source driving sub-circuit for signal transmission. For example, the processor 21 may send a start scan command to the gate driver 23 to start scanning the gate line in the first row in the e-ink screen, and may also send the data driving signals (i.e., data) to the source driver 24.

The memory 22 may store computer programs and data. The memory 22 may include a high speed random access memory, and may further include a non-volatile memory, such as a magnetic disk storage device or a flash memory device. The memory 22 may also be a read-only memory (ROM) or other type of static storage device that is able to store static information and instructions, or a random access memory (RAM) or other type of dynamic storage device that is able to store information and instructions, and may also be a one-time programmable (OTP) memory, an electrically erasable programmable read-only memory (EEPROM), a magnetic disk storage medium or other magnetic storage devices, or any other medium that is able to be used to carry or store program codes in a form of instructions or data structures and is able to be accessed by a computer, but is not limited thereto. The memory 22 may exist independently, and be connected to the processor 21 through a communication line. The memory may also be integrated with the processor 21.

Referring to FIG. 5, the at least one processor 21 is connected to the gate driver 23, the source driver 24, and the at least one memory 22. The gate driver 23 and the source driver 24 are controlled to output corresponding signals by running or executing computer programs stored in the memory(s) 22 and calling data in the memory(s) 22. The at least one processor 21 may be one or more general central processing units (CPUs), microprocessors (also called microcontroller units, MCUs), logic devices, application-specific integrated circuits (ASICs), or integrated circuits used to control execution of programs in some embodiments of the present disclosure. The CPU may be a single core processor (single CPU) or a multi-core processor (multi-CPU). Here, a processor 21 may refer to one or more devices, circuits, or processing cores for processing data (e.g., computer program instructions).

Referring to FIG. 5 again, the display control apparatus 2 may further include a temperature sensor 25 connected to the at least one processor 21. The temperature sensor 25 is configured to measure environmental temperature and send the environmental temperature to the at least one processor 21, so that the at least one processor 21 controls the source driver 24 to output a data driving signal corresponding to the environmental temperature according to the environmental temperature.

Figure 6:
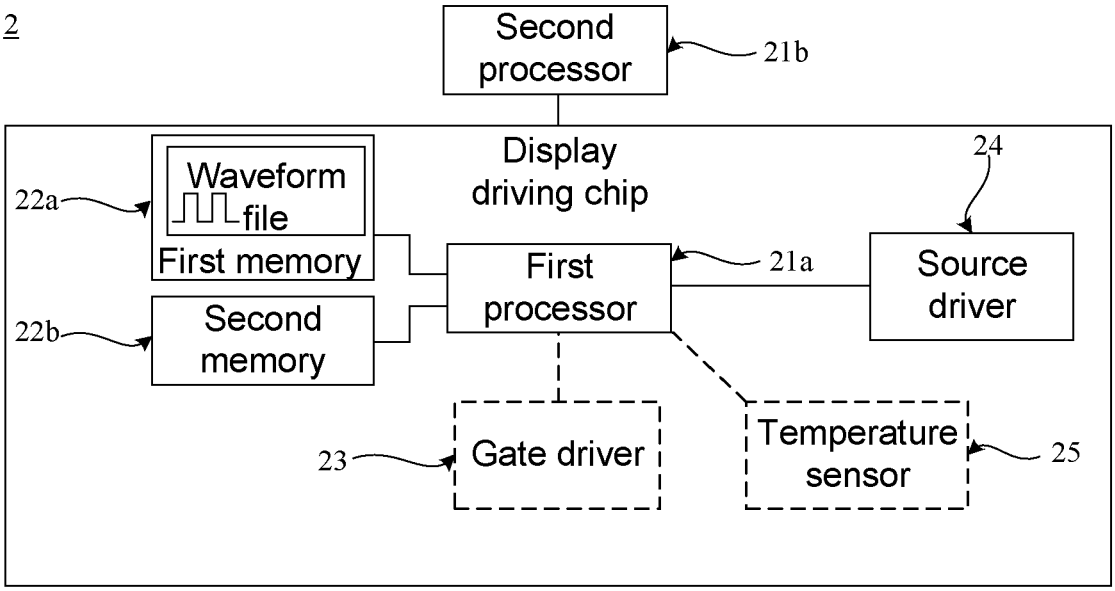
FIG. 6 is a structural diagram of another display control apparatus, in accordance with some embodiments of the present disclosure.

In some other embodiments, referring to FIG. 6, the at least one processor 21 included in the display control apparatus 2 may include a first processor 21*a* and a second processor 21*b*. For example, the first processor 21*a* is the logic device, and the second processor 21*b* may be the microprocessor. Compared to the microprocessor, the logic device may not include a data transmission function. The at least one memory 22 may include a first memory 22*a* and a second memory 22*b*. For example, the first memory 22*a* is the one time programmable memory, and the second memory 22*b* is the random access memory. For example, the first processor 21*a* may realize corresponding functions by running computer programs stored in the first memory 22*a*.

For example, the first processor 21*a*, the first memory 22*a*, the second memory 22*b*, the gate driver 23, the source driver 24, and the temperature sensor 25 may be integrated together as a display driving chip. The display driving chip is electrically connected to the second processor 21*b* through a serial peripheral interface (SPI).

In some embodiments, the communication device 3 is a device for information interaction with an external device (e.g., the AP or the wireless router), and is connected to the at least one processor 21, e.g., may be connected to the second processor 21*b*, so as to send data or a command to the external device, or receive data or a command sent by the external device under a control of the processor(s) 21. The communication device 3 may be a transceiver, a transceiver circuit, a transmitter, a receiver, or the like. For example, the communication device 3 may be a wireless communication device such as a wireless-fidelity (Wi-Fi) device or a Bluetooth device, or may be a wired communication device such as a universal serial bus (USB) interface. The Wi-Fi device provides the e-ink display apparatus 100 with a network access that conforms to Wi-Fi related standard protocols. The Bluetooth device may be an integrated circuit or a Bluetooth chip. For example, the communication device 3 and the processor 21 may be arranged separately or integrated together. For example, the communication device 3 may be integrated with the second processor 21*b*.

In some embodiments, the communication peer device 200 may be a server or a terminal. The terminal may be a personal computer (PC) such as a desktop computer, a notebook computer, a tablet computer, or an ultrabook, or may be a handheld terminal such as a mobile phone.

Based on the above e-ink display apparatus, some embodiments of the present disclosure provide a control method of the e-ink screen 1, and an execution subject thereof may be the display control apparatus 2, or may be a product including the display control apparatus 2, e.g., the e-ink display apparatus 100. Below, the control method of the e-ink screen will be described in an example where the e-ink screen includes the plurality of pixels, at least one pixel includes the first color charged particles, the second color charged particles, and the third color charged particles, and the first color is black, the second color is color (e.g., red), and the third color is white. The charge amount of the black charged particles is same or substantially same as the charge amount of the white charged particles, e.g., both are 11 V to 15 V, and the charge amount of the black charged particles is greater than the charge amount of the color charged particles, e.g., the charge amount of the color charged particles is 4 V to 7 V.

In the e-ink display apparatus, the charged particles of each color correspond to a driving signal, and the driving signal is configured to drive the charged particles of a corresponding color to move, so as to realize display. For example, a first color driving signal is a black driving signal, and the black driving signal is configured to drive the black charged particles to move, so that pixels expected to display black in the e-ink screen display black. A second color driving signal is a color driving signal, and the color driving signal is configured to drive the color charged particles to move, so that pixels expected display color in the e-ink screen display color. A third color driving signal is a white driving signal, and the white driving signal is configured to drive the white charged particles to move, so that pixels expected to display white in the e-ink screen display white. Display of a target image may be realized by inputting a corresponding driving signal to pixels expected to display a target color among the plurality of pixels included in the e-ink screen.

As shown in FIGS. 2 and 3, the display control apparatus 2 may apply a voltage signal (may be referred to as a COM signal, and a voltage value thereof may be expressed by CM) to the second electrode layer 14 in the e-ink screen, and may apply a corresponding data driving signal to the first electrode 131 included in each pixel P according to pixel data of the pixel P in a process of refreshing an image displayed on the e-ink screen 1. The data driving signal may be the first color driving signal, the second color driving signal or the third color driving signal, and each driving signal has a corresponding voltage waveform. It can be understood that in a case where the voltage waveform of the data driving signal is of a high level at a certain driving stage, for example, a voltage value of the high level is greater than the voltage value CM of the COM signal, a first electric field directed from the first electrode 131 to the second electrode 141 is formed in the pixel. The black and red charged particles move towards a side proximate to the display surface of the e-ink screen under an action of the first electric field, and the white charged particles move towards a side away from the display surface of the e-ink screen under the action of the first electric field. In a case where the voltage waveform of the data driving signal is a of low level at a certain driving stage, for example, a voltage value of the low level is less than the voltage value CM of the COM signal, a second electric field directed from the second electrode 141 to the first electrode 131 is formed in the pixel. The black and red charged particles move towards the side away from the display surface of the e-ink screen under an action of the second electric field, and the white charged particles move towards the side proximate to the display surface of the e-ink screen under the action of the second electric field. In a case where the voltage waveform of the data driving signal is of a reference level at a certain driving stage, for example, a voltage value of the reference level is equal to the voltage value CM of the COM signal, no electric field exists in the pixel, and the black, red and white charged particles do not move under the action of the electric field.

The "high level" and the "low level" mentioned in the embodiments of the present disclosure are relative to the voltage value CM of the voltage signal applied to the second electrode layer 14. For example, the voltage value of the high level is 15 V, the voltage value of the low level is −15 V, and the voltage value CM of the COM signal is 0 V. That is, the voltage value of the reference level is 0 V.

Figure 7:
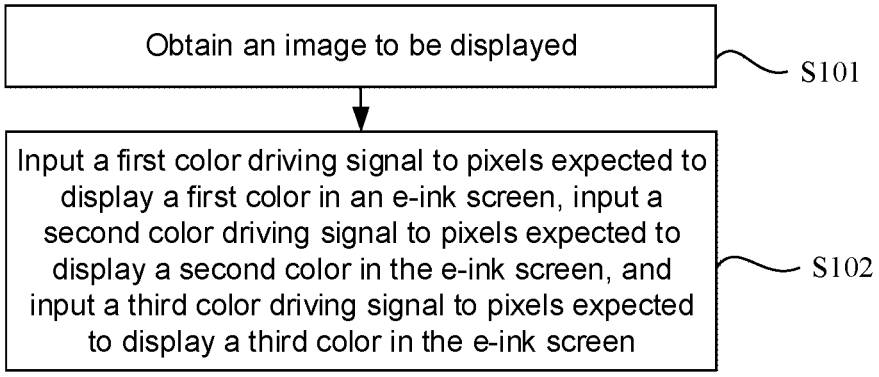
FIG. 7 is a flow diagram of a control method of an e-ink screen, in accordance with some embodiments of the present disclosure.

As shown in FIG. 7, the control method of the e-ink screen includes following steps.

In S101, an image to be displayed (i.e., a target image) is obtained.

Figure 8:
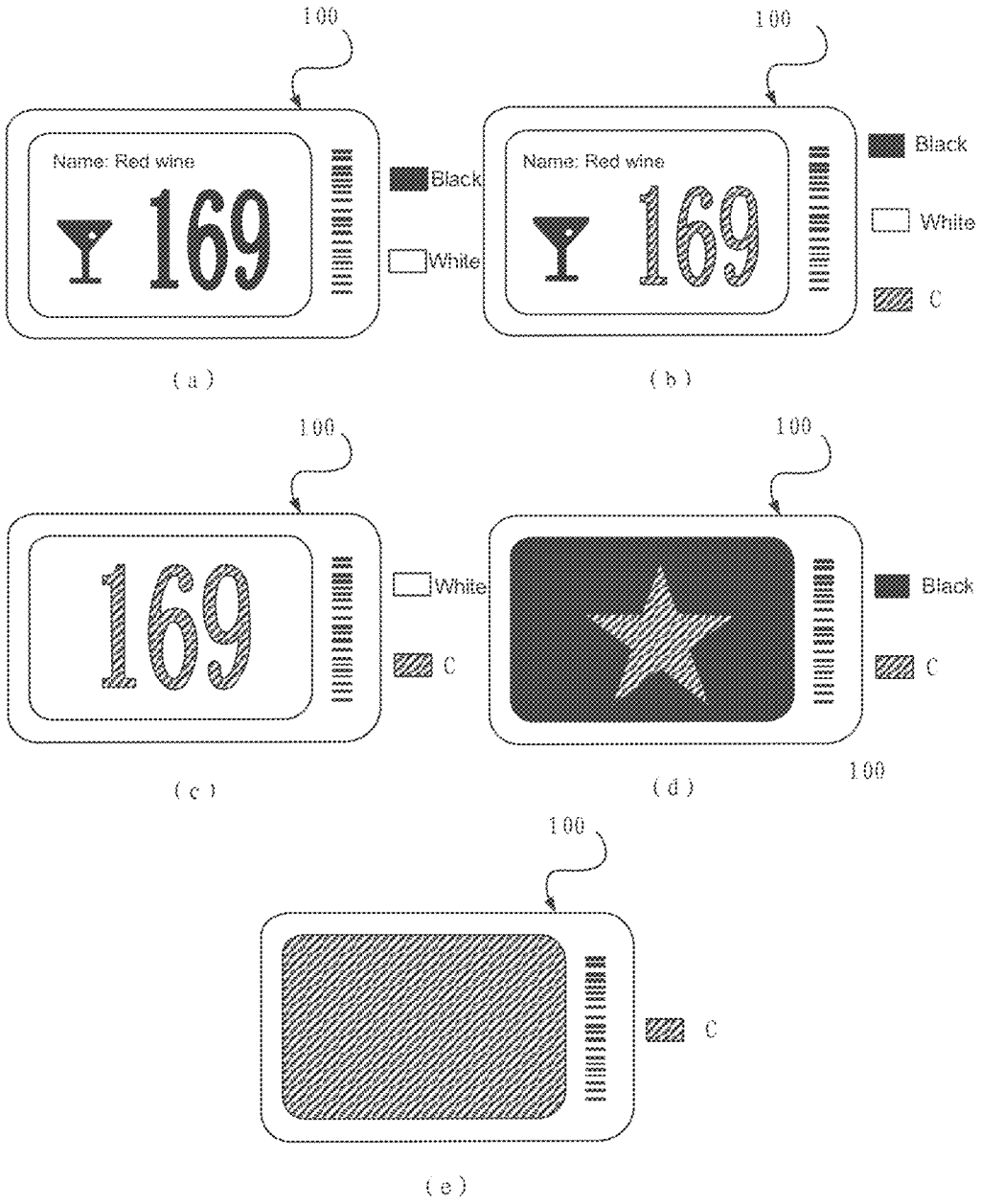
FIG. 8 shows images displayed on an electronic price tag, in accordance with some embodiments of the present disclosure.

In an example where the e-ink display apparatus 100 is used as the electronic price tag, an image to be displayed on the electronic price tag may be regarded as an image that has been input into the electronic price tag but has not yet been displayed. The image to be displayed may be an image including only black and white as shown in (a) in FIG. 8 (that is, the image to be displayed only includes black pixel data and white pixel data), may also be an image including black, white and color (e.g., red) as shown in (b) in FIG. 8 (that is, the image to be displayed includes black pixel data, white pixel data, and color pixel data), may also be an image including white and color as shown in (c) in FIG. 8 (that is, the image to be displayed includes white pixel data and color pixel data), may also be an image including black and color as shown in (d) in FIG. 8 (that is, the image to be displayed includes black pixel data and color pixel data), and of course, may also be an image as shown in (e) in FIG. 8, i.e., a color image (e.g., a red image displayed full screen). In this case, the image to be displayed includes color pixel data.

The image to be displayed includes a plurality of pixel data. Each pixel data may be composed of two bits of data, and the two bits of data determine the color displayed by the pixel corresponding to the pixel data in the e-ink screen 1. If the pixel corresponding to the pixel data displays black, this pixel data is referred to as the black pixel data. Accordingly, the white pixel data and the color pixel data also have similar meanings. For example, the pixel data includes four forms of 00, 01, 10, and 11, where 00 indicates the black pixel data, 01 indicates the white pixel data, 10 and 11 indicate the color pixel data. That is, when a first bit data of the pixel data is 1, this pixel data is the color pixel data, otherwise this pixel data is the black pixel data or the white pixel data.

For example, the communication peer device 200 may send the image to be displayed to the e-ink display apparatus 100 through the wireless router or the wireless access point (AP) 300. In the e-ink display apparatus 100, the at least one processor 21 shown in FIG. 5 may receive the image to be displayed through the communication device 3, and store the image to be displayed in the at least one memory 22. For example, referring to FIG. 6, the second processor 21*b* in the display control apparatus 2 may obtain the image to be displayed through the communication device 3, and send the image to be displayed to the first processor 21*a*. The first processor 21*a* receives the image to be displayed, and stores the image to be displayed in the second memory 22*b*.

Figure 9:
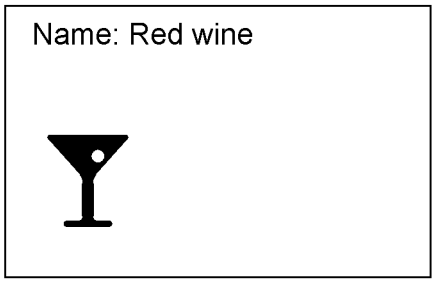
FIG. 9 is a template image of an electronic price tag, in accordance with some embodiments of the present disclosure.

For another example, the at least one memory 22 shown in FIG. 5 may store one or more images. For example, the image may be an image to be displayed, which is configured in advance before an electronic display apparatus leaves factory. For another example, the image may also be a template image. For the electronic price tag, the template image may include a sub-image displaying fixed content (i.e., non-adjustable content) and a sub-image displaying variable content (i.e., adjustable content). The fixed content may include content suitable for different categories, such as a supermarket name and a discount reminder, and the variable content may include content such as a category and price information. The sub-image displaying the variable content may be a white sub-image. For example, FIG. 9 shows a template image for a category of commodities (e.g., red wine). The template image may be read by the at least one processor 21 as the image to be displayed, so as to drive the e-ink screen 1 to display the template image according to subsequent steps. Of course, after the at least one processor 21 receives information including content to be displayed sent by the communication peer device 200 through the communication device 3, the template image may be updated according to information about the variable content, so as to generate a new image to be displayed (e.g., the image shown in (b) in FIG. 8). The new image to be displayed includes the sub-image displaying the fixed content and the sub-image capable of presenting the content to be displayed. The new image to be displayed may also be stored in the at least one memory 22 (e.g., the second memory 22*b*).

Next, S102 is executed.

In S102, the first color driving signal is input to pixels expected to display the first color in the e-ink screen, the second driving signal is input to pixels expected to display the second color in the e-ink screen, and the third driving signal is input to pixels expected to display the third color in the e-ink screen. The first color driving signal is the black driving signal B, the second color driving signal is the color driving signal C, and the third color driving signal is the white driving signal W.

For example, in a case where the image to be displayed includes the color pixel data, the color driving signal C is input to pixels expected to display color in the e-ink screen. For example, in a case where the image to be displayed is the image with color as shown in (b), (c), (d) or (e) in FIG. 8, the color driving signal C is input to the pixels expected to display color in the e-ink screen.

Similarly, in a case where the image to be displayed includes the black pixel data, the black driving signal B is input to pixels expected to display black in the e-ink screen. For example, in a case where the image to be displayed is the image with black shown in (a), (b) or (d) in FIG. 8, the black driving signal B is input to the pixels expected to display black in the e-ink screen.

In a case where the image to be displayed includes the white pixel data, the white driving signal W is input to pixels expected to display white in the e-ink screen. For example, in a case where the image to be displayed is the image with white shown in (a), (b) or (c) in FIG. 8, the white driving signal W is input to the pixels expected to display white in the e-ink screen.

The pixels expected to display black refer to pixels corresponding to the black pixel data in the image to be displayed, the pixels expected to display white refer to pixels corresponding to the white pixel data in the image to be displayed, and the pixels expected to display color refer to pixels corresponding to the color pixel data in the image to be displayed. It will be noted that refreshing processes of the pixels expected to display different colors are synchronized.

Figure 10A:
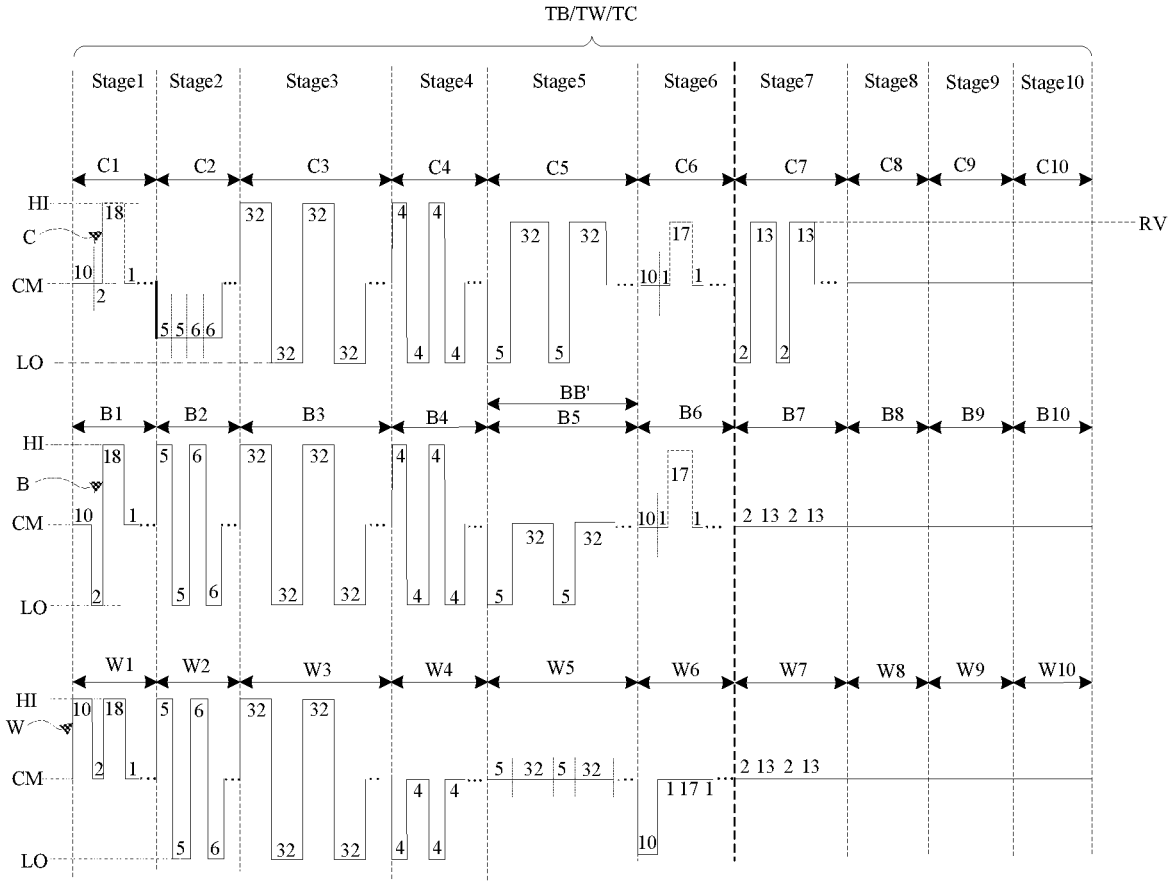
FIG. 10A is a waveform diagram of a data driving signal in a control method of an e-ink screen, in accordance with some embodiments of the present disclosure.
Figure 10B:
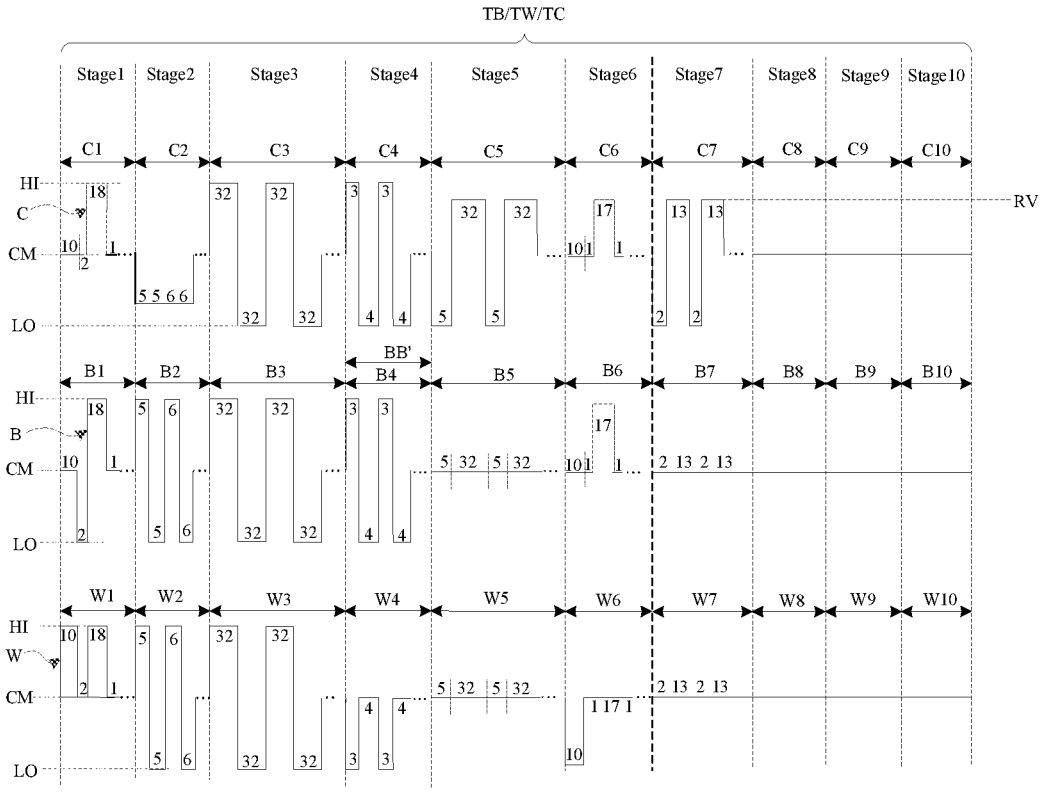
FIG. 10B is a waveform diagram of another data driving signal in a control method of an e-ink screen, in accordance with some embodiments of the present disclosure.
Figure 10C:
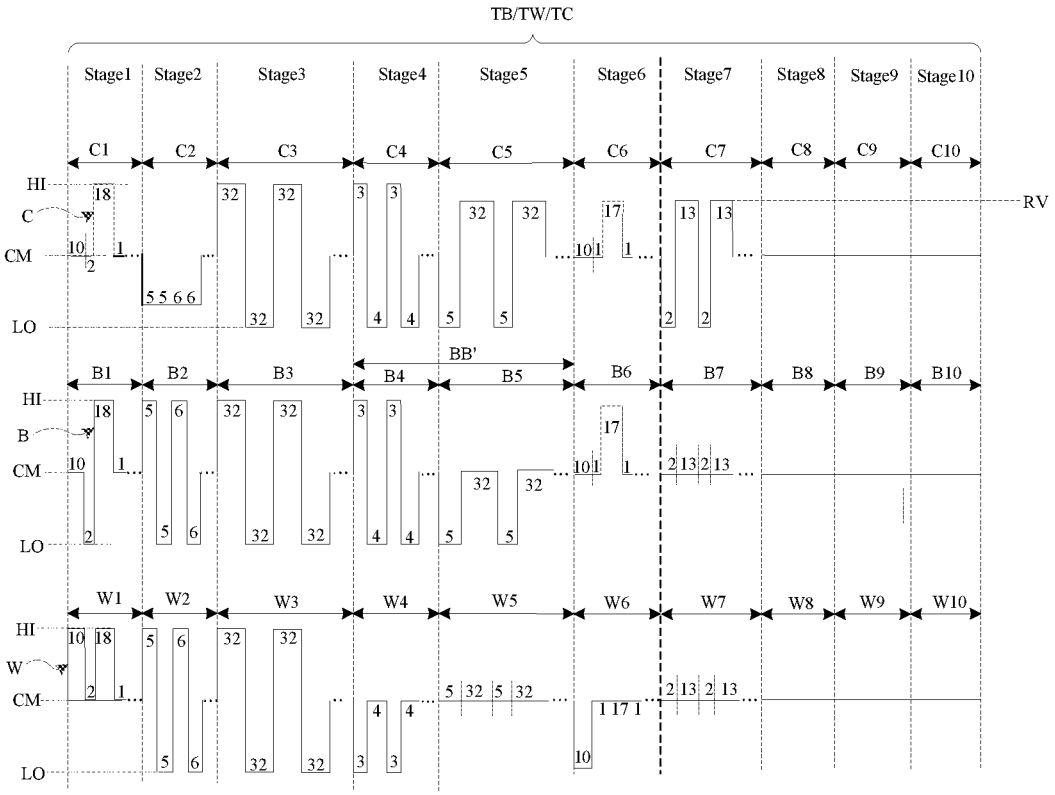
FIG. 10C is a waveform diagram of yet another data driving signal in a control method of an e-ink screen, in accordance with some embodiments of the present disclosure.

As shown in FIGS. 10A to 10C, an entire process of driving the e-ink screen to display by using the control method of the e-ink screen includes a plurality of driving stages. For example, the plurality of driving stages are Stage 1 to Stage 10, and driving durations of the driving stages may be same or different. The first color driving signal, the second color driving signal, and the third color driving signal all include a plurality of sub-signals corresponding to the plurality of driving stages, and each sub-signal may correspond to at least one driving stage. For example, one sub-signal corresponds to one driving stage, or one sub-signal corresponds to two adjacent driving stages. The plurality of sub-signals included in each of the first color driving signal, the second color driving signal, and the third color driving signal will be introduced below.

As shown in FIGS. 10A to 10C, a duration TB of the black driving signal B, a duration TW of the white driving signal W, and a duration TC of the color driving signal C are equal or substantially equal. The durations of the three are substantially equal, which means that an absolute value of a difference between any two is less than or equal to a preset value.

The first color driving signal B will be introduced below.

In some embodiments, as shown in FIGS. 10A to 10C, the first color driving signal (i.e., the black driving signal B) includes the plurality of sub-signals corresponding to the plurality of driving stages, and the plurality of sub-signals include a first color imaging sub-signal B6 and a particle separation sub-signal BB'. The driving stage(s) corresponding to the particle separation sub-signal BB' are at least one driving stage before the driving stage (Stage 6) corresponding to the first color imaging sub-signal.

The first color imaging sub-signal B6 is configured to drive the first color charged particles in the pixel(s) to move towards the side proximate to the display surface of the e-ink screen, so that the pixels expected to display the first color display the first color. For example, the first color imaging sub-signal (i.e., black imaging sub-signal B6) is configured to drive the black charged particles BG in the pixel(s) to move towards the side proximate to the display surface of the e-ink screen, so that the pixels expected to display black display black.

It can be understood that as shown in FIGS. 10A to 10C, the black imaging sub-signal B6 includes a high level with a duration of 17 unit durations. A voltage value of the high level is HI, which is greater than the voltage value CM of the COM signal, so that a first electric field directed from the first electrode 131 to the second electrode 141 is formed in the pixel. The black charged particles BG move towards the side proximate to the display surface of the e-ink screen under an action of the first electric field. The color charged particles CG and the black charged particles BG are same in electrical property, and the color charged particles CG also move towards the side proximate to the display surface of the e-ink screen.

The particle separation sub-signal BB' is configured to drive the first color charged particles and the second color charged particles in the pixel(s) to move, and to separate the first color charged particles from the second color charged particles. For example, the particle separation sub-signal BB' is configured to drive the black charged particles BG and the color charged particles CG in the pixel(s) to move, and to separate the black charged particles BG from the color charged particles CG.

In the e-ink screen, in a case where the black driving signal B does not include the particle separation sub-signal BB', at a sixth driving stage (Stage 6), in a process of driving the black charged particles BG in the pixel(s) to move towards the side proximate to the display surface of the e-ink screen by the black imaging sub-signal B6, since the black charged particles BG and the color charged particles CG are same in electrical property, the color charged particles CG also move towards the side proximate to the display surface of the e-ink screen under an action of the black imaging sub-signal B6. Moreover, in a case where the e-ink screen displays for a long time, the particle activity is decreased, the black charged particles BG and the color charged particles CG move in a same direction and cannot be separated under an action of the driving signal. As a result, in the pixels expected to display black, there are some color charged particles CG at positions proximate to the display surface in addition to the black charged particles BG, resulting in the imaging deviation. That is, the pixels expected to display black also display red, and the problem of reddish black mentioned in the related art occurs.

In the control method of the e-ink screen in some embodiments of the present disclosure, for the first color driving signal (i.e., the black driving signal B), the particle separation sub-signal BB' is arranged before the black imaging sub-signal B6, and thus the black charged particles BG are separated from the color charged particles CG through the particle separation sub-signal BB' before the black imaging sub-signal B6 drives the black charged particles BG in the pixel(s) to move towards the side proximate to the display surface of the e-ink screen to make the pixels expected to display black display black, so that the black charged particles BG and the color charged particles CG are layered with a certain distance therebetween. In this way, at a driving stage (Stage 6) corresponding to the black imaging sub-signal B6, in the pixels expected to display black, the black charged particles BG are driven by the black imaging sub-signal B6 to move to the side proximate to the display surface of the e-ink screen. Even if the color charged particles CG are driven by the black imaging sub-signal B6 to move towards the side proximate to the display surface of the e-ink screen, the black charged particles BG have been separated from the color charged particles CG at a stage before the driving stage (Stage 6), and thus a certain distance is still kept between the black charged particles BG and the color charged particles CG at the driving stage (Stage 6). That is, the black charged particles BG are located closer to the display surface of the e-ink screen than the color charged particles CG, and the black charged particles BG are located above the color charged particles CG, so that the pixels expected to display black do not display red, thereby avoiding the phenomenon of reddish black, so as to avoid the imaging deviation.

The particle separation sub-signal BB' included in the first color driving signal (i.e., the black driving signal B) will be introduced below.

In some embodiments, as shown in FIG. 10A, the particle separation sub-signal BB' includes a first particle separation sub-signal B5', and a driving stage (Stage 5) corresponding to the first particle separation sub-signal B5' is a driving stage before the driving stage (Stage 6) corresponding to the first color imaging sub-signal B6.

The first particle separation sub-signal B5' is a first color push-down sub-signal B5 (i.e., black push-down sub-signal B5). The first color push-down sub-signal B5 is configured to drive the first color charged particles and the second color charged particles to move towards the side away from the display surface of the e-ink screen, and to separate the first color charged particles from the second color charged particles. That is, the black push-down sub-signal B5 is configured to drive the black charged particles and the color charged particles to move towards the side away from the display surface of the e-ink screen, and to separate the black charged particles from the color charged particles.

As shown in FIG. 10A, the black push-down sub-signal B5 includes low levels and reference levels that are alternately arranged in sequence, and a duration of the low level is less than a duration of the reference level. For example, the black push-down sub-signal B5 includes a low level with a duration of 5 unit durations, a reference level with a duration of 32 unit durations, a low level with a duration of 5 unit durations, and a reference level with a duration of 32 unit durations that are arranged in sequence. A second electric field directed from the second electrode 141 to the first electrode 131 is formed in the pixel expected to display black under an action of the black push-down sub-signal B5. Under an action of the second electric field, both the black charged particles BG and the color charged particles CG move towards the side away from the display surface of the e-ink screen. Since the charge amount of the black charged particles BG is greater than the charge amount of the color charged particles CG, the black charged particles BG move faster than the color charged particles CG under the action of the same black push-down sub-signal B5. Therefore, compared with the color charged particles CG, the black charged particles BG run to a position farther away from the display surface of the e-ink screen. That is, the black charged particles BG are located below the color charged particles CG, so that the black charged particles BG and the color charged particles CG have a certain distance therebetween, thereby realizing separation.

At the sixth driving stage (Stage 6), the black charged particles BG and the color charged particles CG move towards the side proximate to the display surface of the e-ink screen under the action of the black imaging sub-signal B6. Since the charge amount of the black charged particles BG is greater than the charge amount of the color charge particles CG, the black charged particles BG move faster than the color charged particles CG under the action of the same black imaging sub-signal B6. Compared with the color charged particles CG, the black charged particles BG run to a position more proximate to the display surface of the e-ink screen. It can be understood that in a movement process of the black charged particles BG and the color charged particles CG at the sixth driving stage (Stage 6), the whole of the black charged particles BG passes through the whole of the color charged particles CG. Finally, the black charged particles BG are located above the color charged particles CG, so that the black charged particles BG and the color charged particles CG still have a certain distance therebetween, and thus the pixels expected to display black display black without displaying red, so as to avoid the imaging deviation.

In some examples, as shown in FIG. 10A, in a case where the particle separation sub-signal BB' includes the first particle separation sub-signal B5', the first color driving signal B further includes a first color first dither sub-signal B4, and a driving stage (Stage 4) corresponding to the first color first dither sub-signal B4 is a driving stage before the driving stage (Stage 5) corresponding to the first particle separation sub-signal B5'. The first color first dither sub-signal B4 includes first levels (high levels) and second levels (low levels) that are alternately arranged in a time sequence, and a duration of the first level is equal to a duration of the second level. For example, the duration of the first level and the duration of the second level both are 4 unit durations. The first level is configured to drive the first color charged particles and the second color charged particles to move towards the side proximate to the display surface of the e-ink screen, and this movement is referred to as a black push movement. The second level is configured to drive the first color charged particles and the second color charged particles to move towards the side away from the display surface of the e-ink screen (that is, the third color charged particles are driven to move towards the side proximate to the display surface of the e-ink screen), and this movement is referred to as a white push movement.

The first color first dither sub-signal B4 is configured to drive the first color charged particles and the second color charged particles to wobble, and the duration of the first level is set to be equal to the duration of the second level. On one hand, it is possible to separate the first color charged particles from the second color charged particles by wobbling the first color charged particles and the second color charged particles. On another hand, the imaging deviation caused by unequal durations of the black push movement and the white push movement is avoided. For example, an insufficient black chroma displayed by the pixel expected to display black and an insufficient white chroma displayed by the pixel expected to display white are avoided.

In some other embodiments, as shown in FIG. 10B, the particle separation sub-signal BB' includes a second particle separation sub-signal B4', and a driving stage (Stage 4) corresponding to the second particle separation sub-signal B4' is a driving stage before the driving stage (Stage 6) corresponding to the first color imaging sub-signal B6.

The second particle separation sub-signal B4' includes a first color first dither sub-signal B4. The first color first dither sub-signal B4 includes first levels and second levels that are alternately arranged in a time sequence, and a duration of the first level is less than a duration of the second level. For example, as shown in FIG. 10B, the first color first dither sub-signal B4 includes a first level with a duration of 3 unit durations, a second level with a duration of 4 unit durations, a first level with a duration of 3 unit durations and a second level with a duration of 4 unit durations that are arranged in sequence. The first level is a high level, and a voltage value thereof is HI. The second level is a low level, and a voltage value thereof is LO.

The second particle separation sub-signal B4' is configured to drive the first color charged particles and the second color charged particles to wobble. The first level is configured to drive the first color charged particles and the second color charged particles to move towards the side proximate to the display surface of the e-ink screen. The second level is configured to drive the first color charged particles and the second color charged particles to move towards the side away from the display surface of the e-ink screen. Here, the wobbling of the first color charged particles and the second color charged particles means that the first color charged particles and the second color charged particles reciprocate in the pixel(s).

The first electric field directed from the first electrode 131 to the second electrode 141 and the second electric field directed from the second electrode 141 to the first electrode 131 are alternately formed in the pixel expected to display black under driving of the second particle separation sub-signal B4', so that the black charged particles BG and the color charged particles CG reciprocate under the action of the first electric field and the second electric field, so as to make the black charged particles BG and the color charged particles CG wobble. Since the duration of the first level is less than the duration of the second level, that is, a duration of the black charged particles BG and the color charged particles CG subjected to the second electric field is longer, a duration of the white push movement is longer than a duration of the black push movement, so that a duration of the black charged particles BG and the color charged particles CG moving towards the side away from the display surface of the e-ink screen is longer. Since the charge amount of the black charged particles BG is greater than the charge amount of the color charged particles CG, the black charged particles BG move faster than the color charged particles CG under the action of the same second electric field. Therefore, compared with the color charged particles CG, the black charged particles BG run to a position father away from the display surface of the e-ink screen. That is, the black charged particles BG are located below the color charged particles CG, so that the black charged particles BG and the color charged particles CG have a certain distance therebetween, thereby realizing separation.

Next, at the sixth driving stage (Stage 6), the black charged particles BG and the color charged particles CG move towards the side proximate to the display surface of the e-ink screen under the action of the black imaging sub-signal B6. Since the charge amount of the black charged particles BG is greater than the charge amount of the color charged particles CG, the black charged particles BG move faster than the color charged particles CG under the action of the same black imaging sub-signal B6. Compared with the color charged particles CG, The black charged particles BG run to a position more proximate to the display surface of the e-ink screen. It can be understood that in the movement process of the black charged particles BG and the color charged particles CG at the sixth driving stage (Stage 6), the whole of the black charged particles BG passes through the whole of the color charged particles CG. Finally, the black charged particles BG are located above the color charged particles CG, so that the black charged particles BG and the color charged particles CG still have a certain distance therebetween, and thus the pixels expected to display black display black without displaying red, so as to avoid the imaging deviation.

In some examples, as shown in FIG. 10B, the first color driving signal B includes an electric field cancellation sub-signal B5 corresponding to a fifth driving stage (Stage 5). A voltage waveform of the electric field cancellation sub-signal B5 is of the reference level, and a voltage value thereof is CM. Therefore, at the fifth driving stage (Stage 5), no electric field exists in the pixels expected to display black, and the electric field cancellation sub-signal B5 does not have a driving effect on the black charged particles BG and the color charged particles CG, and also does not affect the separation effect of the black charged particles BG and the color charged particles CG by the second particle separation sub-signal B4'.

In yet other embodiments, as shown in FIG. 10C, the particle separation sub-signal BB' includes a first particle separation sub-signal B5' and a second particle separation sub-signal B4'. A driving stage (Stage 5) corresponding to the first particle separation sub-signal B5' precedes the driving stage (Stage 6) corresponding to the first color imaging sub-signal B6, and a driving stage (Stage 4) corresponding to the second particle separation sub-signal B4' precedes the driving stage (Stage 5) corresponding to the first particle separation sub-signal B5'. In other words, the particle separation sub-signal BB' includes sub-signals corresponding to two consecutive driving stages.

The first particle separation sub-signal B5' includes a first color push-down sub-signal B5. The first color push-down sub-signal B5 is configured to drive the first color charged particles and the second color charged particles to move towards the side away from the display surface of the e-ink screen, and to separate the first color charged particles from the second color charged particles. That is, the first color push-down sub-signal B5 (i.e., black push-down sub-signal B5) is configured to drive the black charged particles and the color charged particles to move towards the side away from the display surface of the e-ink screen, and to separate the black charged particles from the color charged particles.

The second particle separation sub-signal B4' includes a first color first dither sub-signal B4. The first color first dither sub-signal B4 includes first levels and second levels that are alternately arranged in a time sequence, and a duration of the first level is less than a duration of the second level.

The second particle separation sub-signal is configured to drive the first color charged particles and the second color charged particles to wobble. The first level is configured to drive the first color charged particles and the second color charged particles to move towards the side proximate to the display surface of the e-ink screen. The second level is configured to drive the first color charged particles and the second color charged particles to move towards the side away from the display surface of the e-ink screen.

As shown in FIG. 10C, before the sixth driving stage (Stage 6), that is, before the first color imaging sub-signal B6 drives the black charged particles BG in the pixel(s) to move towards the side proximate to the display surface of the e-ink screen to make the pixels expected to display black display black, the first color charged particles are separated from the second color charged particles.

First, at a fourth driving stage (Stage 4), the first electric field directed from the first electrode 131 to the second electrode 141 and the second electric field directed from the second electrode 141 to the first electrode 131 are alternately formed in the pixel expected to display black under driving of the second particle separation sub-signal B4', so that the black charged particles BG and the color charged particles CG reciprocate under the action of the first electric field and the second electric field, so as to make the black charged particles BG and the color charged particles CG wobble. Since the duration of the first level is less than the duration of the second level, that is, a duration of the black charged particles BG and the color charged particles CG subjected to the second electric field is longer, a duration of the white push movement is longer than a duration of the black push movement, so that a duration of the black charged particles BG and the color charged particles CG moving towards the side away from the display surface of the e-ink screen is longer. Since the charge amount of the black charged particles BG is greater than the charge amount of the color charged particles CG, the black charged particles BG move faster than the color charged particles CG under the action of the same second electric field. Therefore, compared with the color charged particles CG, the black charged particles BG run to a position father away from the display surface of the e-ink screen. That is, the black charged particles BG are located below the color charged particles CG, so that the black charged particles BG and the color charged particles CG have a certain distance therebetween, thereby realizing separation.

Next, at the fifth driving stage (Stage 5), the second electric field directed from the second electrode 141 to the first electrode 131 is formed in the pixel expected to display black under an action of the black push-down sub-signal B5. Under the action of the second electric field, both the black charged particles BG and the color charged particles CG move towards the side away from the display surface of the e-ink screen. Since the charge amount of the black charged particles BG is greater than the charge amount of the color charged particles CG, the black charged particles BG move farther than the color charged particles CG under the action of the same black push-down sub-signal B5. Therefore, compared with the color charged particles CG, the black charged particles BG run to a position farther away from the display surface of the e-ink screen. That is, the black charged particles BG are located below the color charged particles CG, so that the black charged particles BG and the color charged particles CG have a certain distance therebetween, thereby further separating the black charged particles BG and the color charged particles CG on the basis of the previous driving stage. Therefore, the separation effect of the black charged particles BG and the color charged particles CG is enhanced through the combined action of the first particle separation sub-signal B5' and the second particle separation sub-signal B4', so that the phenomenon of reddish black is effectively avoided when the pixels expected to display black display black.

In some embodiments, the plurality of sub-signals included in the first color driving signal B further include a first color balance sub-signal B1, and a driving stage corresponding to the first color balance sub-signal B1 is a first driving stage (Stage 1) among the plurality of driving stages.

The first color balance sub-signal B1 is configured to make a position of the first color charged particles at an initial position. The initial position is a position of the first color charged particles in a case where the pixel expected to display the first color is not driven by the first color driving signal. For example, the first color balance sub-signal B1 is configured to make a position of the black charged particles at an initial position. The initial position is a position of the black charged particles in a case where the pixel expected to display black is not driven by the black driving signal B, e.g., the black charged particles are evenly distributed in the pixel(s).

In this way, the position of the first color charged particles is set to the initial position through the first color balance sub-signal B1, so that the running of the first color charged particles may be balanced, so as to avoid the imaging deviation caused by excessive push times of the first color charged particles.

In some examples, as shown in FIGS. 10A to 10C, the first color balance sub-signal B1 includes a reference level, a third level, a fourth level, and a reference level that are sequentially arranged. A voltage value of the reference level is CM.

A level polarity of the third level is opposite to a level polarity of the first color imaging sub-signal. Here, the level polarity of the first color imaging sub-signal is a polarity of a level of the first color imaging sub-signal that generates a driving effect on the first color charged particles. For example, the first color imaging sub-signal B6 includes the high level with the duration of 17 unit durations, and the voltage value of the high level is HI. In an example where the voltage value of the reference level is 0 V, the level polarity of the first color imaging sub-signal is positive, then the level polarity of the third level is negative, and a voltage value of the third level is LO.

As shown in FIGS. 10A and 10C, in the case where the particle separation sub-signal BB' includes the first particle separation sub-signal B5', a level polarity of the fourth level is opposite to a level polarity of the first particle separation sub-signal B5'. Here, the level polarity of the first particle separation sub-signal B5' is a polarity of a level of the first particle separation sub-signal B5' that generates a driving effect on the first color charged particles. For example, the first particle separation sub-signal B5' includes a low level with a duration of 5 unit durations, and a voltage value of the low level is LO. In an example where the voltage value CM of the reference level is 0 V, the level polarity of the first particle separation sub-signal B5' is negative, then the level polarity of the fourth level is positive, and a voltage value of the fourth level is HI.

As shown in FIGS. 10B and 10C, in a case where the particle separation sub-signal BB' includes the second particle separation sub-signal B4', the second particle separation sub-signal B4' includes the first levels and the second levels that are alternately arranged in the time sequence. The polarity of the fourth level is opposite to a polarity of the second level, and the second level is a low level, and the voltage value thereof is LO. In the example where the voltage value CM of the reference level is 0 V, the level polarity of the second level is negative, then the level polarity of the fourth level is positive, and the voltage value of the fourth level is HI.

As a possible design, in order to balance the running of the first color charged particles, durations of the reference level, the third level, the fourth level, and the reference level that are arranged in sequence in the first color balance sub-signal B1 are set to be able to return the first color charged particle to the initial position in a case where the pixel expected to display the first color is not driven by the first color driving signal. For example, the at least one processor in the display control apparatus set durations of the high levels and the low levels of each sub-signal in the first color driving signal B through calculation and data compensation, so that a total duration of the high levels is equal to a total duration of the low levels in the first color driving signal B, so as to realize a final balance.

For example, as shown in FIG. 10C, the first color balance sub-signal B1 includes a reference level with a duration of 10 unit durations, a third level (low level) with a duration of 2 unit durations, a fourth level (high level) with a duration of 18 unit durations, and a reference level with a duration of 1 unit duration that are sequentially arranged.

In some embodiments, as shown in FIG. 10C, the first color driving signal B includes sub-signals corresponding to at least seven driving stages. Sub-signals corresponding to the first driving stage (Stage 1) to a seventh driving stage (Stage 7) included in the first color driving signal B are sequentially the first color balance sub-signal B1, a first color second dither sub-signal B2, a first color third dither sub-signal B3, the first color first dither sub-signal B4, the first color push-down signal B5, the first color imaging sub-signal B6, and an electric field cancellation sub-signal B7.

The first color balance sub-signal B1 is configured to make the position of the first color charged particles at the initial position. The initial position is the position of the first color charged particles in the case where the pixel expected to display the first color is not driven by the first color driving signal.

The first color second dither sub-signal B2 is configured to drive the first color charged particles to wobble. For example, the first color second dither sub-signal B2 is able to drive the black charged particles to wobble in advance.

The first color third dither sub-signal B3 is configured to drive the first color charged particles to continue to wobble. For example, the first color third dither sub-signal B3 is able to drive the black charged particles to continue to wobble.

The first color second dither sub-signal B2 and the first color third dither sub-signal B3 are able to keep the black charged particles BG moving to avoid an afterimage phenomenon.

The first color first dither sub-signal B4 is configured to drive the first color charged particles and the second color charged particles to wobble, and to separate the first color charged particles from the second color charged particles. For example, the first color first dither sub-signal B4 is able to drive the black charged particles BG and the color charged particles CG to continue to wobble, and is able to move the black charged particles BG and the color charged particles CG to be separated due to a fact that the duration of the first level is less than the duration of the second level in the first color first dither sub-signal B4. Therefore, the black charged particles BG are located below the color charged particles CG. That is, the black charged particles BG are located on a side of the color charged particles CG away from the display surface of the e-ink screen.

The first color push-down sub-signal B5 is configured to drive the first color charged particles and the second color charged particles to move towards the side away from the display surface of the e-ink screen, and to separate the first color charged particles from the second color charged particles. For example, the first color push-down sub-signal B5 is the black push-down sub-signal B5, which is able to drive the black charged particles BG and the color charged particles CG to move towards the side away from the display surface of the e-ink screen. At this stage, the black charged particles BG are located below the color charged particles CG, and the white charged particles WG are located above the color charged particles CG, i.e., on the side proximate to the display surface.

The first color imaging sub-signal B6 is configured to drive the first color charged particles in the pixel(s) to move towards the side proximate to the display surface of the e-ink screen, so that the pixels expected to display the first color display the first color. For example, the first color imaging sub-signal B6 is able to drive the black charged particles BG to move towards the side proximate to the display surface of the e-ink screen, and the color charged particles CG also move towards the side proximate to the display surface of the e-ink screen under the action of the first color imaging sub-signal B6. Since the black charged particles BG are separated from the color charged particles CG under the combined action of the first color first dither sub-signal B4 and the first color push-down signal B5, the black charged particles BG are located at the positions proximate to the display surface at the sixth driving stage (Stage 6), so that the black charged particles BG are not mixed with the color charged particles CG.

The electric field cancellation sub-signal B7 is configured to cancel driving to the first color charged particles. The electric field cancellation sub-signal B7 is a signal for making the electric field of the pixel zero. A voltage waveform of the electric field cancellation sub-signal B7 is of a reference level. A voltage value of the reference level is equal to a voltage value of the second electrode layer, so that the first electrode and the second electrode in the pixel have no voltage difference therebetween, and the black charged particles in the pixel(s) are still located at the positions proximate to the display surface by inertia.

In some embodiments, the first color driving signal B further includes sub-signals corresponding to an eighth driving stage (Stage 8) to a tenth driving stage (Stage 10), and the sub-signals are sequentially an electric field cancellation sub-signal B8, an electric field cancellation sub-signal B9, and an electric field cancellation sub-signal B10. That is, at the eighth driving stage (Stage 8) to the tenth driving stage (Stage 10), the first color driving signal B no longer has a driving effect on the first color charged particles. The e-ink screen 1 has the bistable characteristics, and even if the electric field in the e-ink screen is cancelled, a last refreshed image may stay on the e-ink screen 1. Therefore, the black charged particles in the pixel(s) expected to display black are still in the state of the sixth driving stage (Stage 6) at the eighth driving stage (Stage 8) to the tenth driving stage (Stage 10), so that the pixels expected to display black are able to continuously display black.

As an example, referring to FIG. 10C, the first color driving signal B may be expressed as:

{CM, LO, HI, CM}, //the sub-signal corresponding to the first driving stage (Stage 1);

{HI, LO, HI, LO}, //the sub-signal corresponding to the second driving stage (Stage 2);

{HI, LO, HI, LO}, //the sub-signal corresponding to the third driving stage (Stage 3)

{HI, LO, HI, LO}, //the sub-signal corresponding to the fourth driving stage (Stage 4);

{LO, CM, LO, CM}, //the sub-signal corresponding to the fifth driving stage (Stage 5);

{CM, CM, HI, CM}, //the sub-signal corresponding to the sixth driving stage (Stage 6);

{CM, CM, CM, CM}, //the sub-signal corresponding to the seventh driving stage (Stage 7);

{CM, CM, CM, CM}, //the sub-signal corresponding to the eighth driving stage (Stage 8);

{CM, CM, CM, CM}, //the sub-signal corresponding to the ninth driving stage (Stage 9);

{CM, CM, CM, CM}, //the sub-signal corresponding to the tenth driving stage (Stage 10).

Each row represents a cyclic unit in the sub-signal corresponding to a driving stage. That is, the cyclic unit includes the above four parts. From the above data, a voltage value of each of the four parts included in each cycle unit may be seen.

Referring to numbers marked at the waveforms of the first color driving signal B in FIG. 10C, the cycle unit in the sub-signal corresponding to each driving stage includes four parts. A voltage amplitude of each part is different, and the number of cyclic units included in the sub-signal corresponding to each driving stage is also different. Durations of the four parts included in the cyclic unit in the sub-signal corresponding to each driving stage, and the repetition number (cycle number, i.e., the cycle number of the four parts) of the cyclic unit are represented by the following data. The duration is characterized by the number of unit durations, which may be, for example, a hexadecimal number. For example, the duration is 0x0a, which indicates 10 unit durations.

{0x0a, 0x02, 0x12, 0x01, 0x04}, //the sub-signal corresponding to the first driving stage (Stage 1);

{0x05, 0x05, 0x06, 0x06, 0x07}, //the sub-signal corresponding to the second driving stage (Stage 2);

{0x20, 0x20, 0x20, 0x20, 0x08}, //the sub-signal corresponding to the third driving stage (Stage 3);

{0x03, 0x04, 0x03,0x04, 0x24}, //the sub-signal corresponding to the fourth driving stage (Stage 4);

{0x05, 0x20, 0x05, 0x20, 0x06}, //the sub-signal corresponding to the fifth driving stage (Stage 5);

{0x0a, 0x01, 0x11, 0x01, 0x04}, //the sub-signal corresponding to the sixth driving stage (Stage 6);

{0x02, 0x0d, 0x02, 0x0d, 0x02}, //the sub-signal corresponding to the seventh driving stage (Stage 7);

{0x02, 0x0d, 0x02, 0x0d, 0x02}, //the sub-signal corresponding to the eighth driving stage (Stage 8);

{0x00, 0x00, 0x00, 0x00, 0x00}, //the sub-signal corresponding to the ninth driving stage (Stage 9);

{0x00, 0x00, 0x00, 0x00, 0x00}, //the sub-signal corresponding to the tenth driving stage (Stage 10).

Considering the sub-signal (the first color first dither sub-signal B4) of the first color driving signal B corresponding to the fourth driving stage (Stage 4) as an example, the four parts of the cyclic unit include a high level with a duration of 0x03 and a voltage value of HI, a low level with a duration of 0x04 and a voltage value of LO, a high level with a duration of 0x03 and a voltage value of HI, and a low level with a duration of 0x04 and a voltage value of LO. The cyclic unit is repeated 24 times.

It will be noted that as shown in FIG. 10C, for the second color driving signal C and the third color driving signal W, the second color driving signal C (i.e., color driving signal C) includes a plurality of sub-signals corresponding to the plurality of driving stages, and the third color driving signal W (i.e., white driving signal W) includes a plurality of sub-signals corresponding to the plurality of driving stages. Each sub-signal has a corresponding voltage waveform. In the second color driving signal C and the third color driving signal W, durations of four parts included in a cycle unit in the sub-signal corresponding to each driving stage and the repetition number the cycle unit, both are consistent with the durations of the four parts included in the cyclic unit in the sub-signal of the first color driving signal B corresponding to each driving stage and the repetition number of the cyclic unit. A difference between the first color driving signal B, the second color driving signal C, and the third color driving signal W is that the voltage waveforms are different.

The second color driving signal C will be introduced below.

In some embodiments, as shown in FIGS. 10B and 10C, the second color driving signal C (i.e., the color driving signal C) includes a plurality of sub-signals corresponding to the plurality of driving stages. In a case where the first color driving sub-signal B includes the second particle separation sub-signal B4', the second color driving signal C includes a second color first dither sub-signal C4. A driving stage corresponding to the second color first dither sub-signal C4 and the driving stage corresponding to the second particle separation sub-signal B4' are the same driving stage, and both are the fourth driving stage (Stage 4).

The second color first dither sub-signal C4 includes fifth levels and sixth levels that are alternately arranged in a time sequence. A duration of the fifth level is equal to the duration of the first level, and a duration of the sixth level is equal to the duration of the second level. Since the data of the sub-signal corresponding to the fourth driving stage (Stage 4) is {0x03, 0x04, 0x03, 0x04, 0x24}, the second color first dither sub-signal C4 includes a fifth level with a duration of 3 unit durations, a sixth level with a duration of 4 unit durations, a fifth level with a duration of 3 unit durations, and a sixth level with a duration of 4 unit durations that are arranged in sequence. The fifth level is a high level, and a voltage value thereof is HI. The sixth level is a low level, and a voltage value thereof is LO. That is, for the second color first dither sub-signal C4, the duration of the fifth level is less than the duration of the sixth level.

The second color first dither sub-signal C4 is configured to drive the first color charged particles and the second color charged particles to wobble. The fifth level is configured to drive the first color charged particles and the second color charged particles to move towards the side proximate to the display surface of the e-ink screen, and the sixth level is configured to drive the first color charged particles and the second color charged particles to move towards the side away from the display surface of the e-ink screen. Here, the wobbling of the first color charged particles and the second color charged particles means that the first color charged particles and the second color charged particles reciprocate in the pixel(s).

The first electric field directed from the first electrode 131 to the second electrode 141 and the second electric field directed from the second electrode 141 to the first electrode 131 are alternately formed in the pixel expected to display color under driving of the second color first dither sub-signal C4, so that the black charged particles BG and the color charged particles CG reciprocate under the action of the first electric field and the second electric field, so as to make the black charged particles BG and the color charged particles CG wobble. Since the duration of the fifth level is less than the duration of the sixth level, that is, a duration of the black charged particles BG and the color charged particles CG subjected to the second electric field is longer, a duration of the white push movement is longer than a duration of the black push movement, so that a duration of the black charged particles BG and the color charged particles CG moving towards the side away from the display surface of the e-ink screen is longer. Since the charge amount of the black charged particles BG is greater than the charge amount of the color charged particles CG, the black charged particles BG move faster than the color charged particles CG under the action of the same second electric field. Therefore, compared with the color charged particles CG, the black charged particles BG run to a position father away from the display surface of the e-ink screen. That is, the black charged particles BG are located below the color charged particles CG, so that the black charged particles BG and the color charged particles CG have a certain distance therebetween, thereby realizing separation.

In this way, the second color first dither sub-signal C4 is able to separate the black charged particles BG from the color charged particles CG in the pixel expected to display color, thereby avoiding the imaging deviation caused by unseparated particles at a subsequent driving stage.

In some embodiments, as shown in FIG. 10C, the second color driving signal C includes sub-signals corresponding to at least seven driving stages. Sub-signals corresponding to the first driving stage (Stage 1) to the seventh driving stage (Stage 7) included in the second color driving signal C are sequentially a second color inversion sub-signal C1, a second color balance sub-signal C2, a second color second dither sub-signal C3, the second color first dither sub-signal C4, a second color pre-imaging sub-signal C5, a second color push-up sub-signal C6, and a second color imaging sub-signal C7.

The second color inversion sub-signal C1 is configured to drive the second color charged particles to invert, so that the second color charged particles move towards the side proximate to the display surface of the e-ink screen.

The second color balance sub-signal C2 is configured to make a position of the second color charged particles at an initial position. The initial position is a position of the second color charged particles in a case where the pixel expected to display the second color is not driven by the second color driving signal C.

The second color inversion sub-signal C1 and the second color balance sub-signal C2 are opposite in level polarity. At the first driving stage (Stage 1) and the second driving stage (Stage 2), the second color inversion sub-signal drives the color charged particles to move towards the side proximate to the display surface of the e-ink screen, and the second color balance sub-signal C2 drives the color charged particles to move towards the side away from the display surface of the e-ink screen. Under the combined action of the second color inversion sub-signal C1 and the second color balance sub-signal C2, the color charged particle is able to be at the initial position stably. For example, the color charged particles are evenly dispersed in the pixel(s), so as to avoid the imaging deviation caused by excessive push times of the color charged particles.

The second color second dither sub-signal C3 is configured to drive the second color charged particles to wobble. For example, the second color second dither sub-signal C3 is able to drive the color charged particles CG to wobble in advance.

The second color first dither sub-signal C4 is configured to drive the second color charged particles to continue to wobble. For example, the second color first dither sub-signal C4 is able to drive the color charged particles CG to continue to wobble.

The second color second dither sub-signal C3 and the second color first dither sub-signal C4 are able to keep the color charged particles CG moving to avoid the afterimage phenomenon. Moreover, since the duration of the fifth level is less than the duration of the sixth level in the second color first dither sub-signal C4, the black charged particles BG are able to be separated from the color charged particles CG under an action of the second color first dither sub-signal C4, and the black charged particles BG are located below the color charged particles CG.

The second color pre-imaging sub-signal C5 is configured to drive the second color charged particles in the pixel(s) to move towards the side proximate to the display surface of the e-ink screen. For example, the second color pre-imaging sub-signal C5 is configured to drive the color charged particles in the pixel(s) to move towards the side proximate to the display surface of the e-ink screen.

As shown in FIG. 10C, the second color pre-imaging sub-signal C5 includes eighth levels and ninth levels that are alternately arranged in sequence, and a duration of the eighth level is less than a duration of the ninth level. For example, the second color pre-imaging sub-signal C5 includes an eighth level with a duration of 5 unit durations, a ninth level with a duration of 32 unit durations, an eighth level with a duration of 5 unit durations, and a ninth level with a duration of 32 unit durations. The eighth level is a low level, and a voltage value thereof is LO. A voltage value of the ninth level is RV, and the voltage value RV of the ninth level is less than the voltage value HI of the high level, and is greater than the voltage value CM of the reference level. For example, LO is −15 V, HI is 15 V, and RV is 6 V. The eighth level is configured to drive the color charged particles and the black charged particles to move towards the side away from the display surface of the e-ink screen, and the ninth level is configured to drive the color charged particles to move towards the side proximate to the display surface of the e-ink screen.

At the fifth driving stage (Stage 5), the black charged particles and the color charged particles are first driven by the eighth level of the second color pre-imaging sub-signal C5 to move towards the side away from the display surface of the e-ink screen. Since the charge amount of the black charged particles is greater than the charge amount of the color charged particles, the black charged particles run to a position father away from the display surface. The color charged particles move towards the side proximate to the display surface of the e-ink screen under an action of the ninth level. Since the voltage value RV of the ninth level is less than the voltage value HI of the high level, the ninth level is insufficient to drive the black charged particles to move (refer to that the voltage value of the sub-signal of the first color driving signal that is able to drive the black charged particles to move is HI or LO, i.e., a voltage amplitude is required to be greater than a certain value, for example, greater than 15 V). Therefore, the color charged particles are located above the black charged particles at this stage, and are closer to the display surface of the e-ink screen, so that the pixels expected to display color display color.

The second color push-up sub-signal C6 is configured to drive the second color charged particles in the pixel(s) to move towards the side proximate to the display surface of the e-ink screen. For example, the second color push-up sub-signal C6 is configured to drive the color charged particles in the pixel(s) to move towards the side proximate to the display surface of the e-ink screen.

The second color push-up signal includes a ninth level with a duration of 17 unit durations, and a voltage value of the ninth level is RV, which is less than the voltage value of the high level HI. Therefore, at the sixth driving stage (Stage 6), the color charged particles CG further move towards the side proximate to the display surface of the e-ink screen, and the black charged particles do not move with the color charged particles towards the side proximate to the display surface of the e-ink screen.

The second color imaging sub-signal C7 is configured to drive the second color charged particles in the pixel(s) to move towards the side proximate to the display surface of the e-ink screen, so that the pixels expected to display the second color display the second color. For example, the second color imaging sub-signal C7 is configured to drive the color charged particles in the pixel(s) to move towards the side proximate to the display surface of the e-ink screen, so that the pixels expected to display color display color.

The second color imaging sub-signal C7 includes eighth levels and ninth levels that are alternately arranged in sequence. For details, reference may be made to the description of the second color pre-imaging sub-signal C5. A difference between the second color imaging sub-signal C7 and the second color pre-imaging sub-signal C5 is that durations of the levels are different, which will not be repeated here.

The second color pre-imaging sub-signal C5 and the second color imaging sub-signal C7 are able to make the second color charged particles in the pixel(s) expected to display the second color located on the side proximate to the display surface, thereby making the display effect good.

In some embodiments, the second color driving signal C further includes sub-signals corresponding to the eighth driving stage (Stage 8) to the tenth driving stage (Stage 10), and the sub-signals are sequentially an electric field cancellation sub-signal C8, an electric field cancellation sub-signal C9, and an electric field cancellation sub-signal C10. That is, at the eighth driving stage (Stage 8) to the tenth driving stage (Stage 10), the second color driving signal C no longer has a driving effect on the second color charged particles. The e-ink screen 1 has the bistable characteristics, and even if the electric field in the e-ink screen is cancelled, a last refreshed image may stay on the e-ink screen 1. Therefore, the color charged particles in the pixel(s) expected to display color are still in the state of the seventh driving stage (Stage 7) at the eighth driving stage (Stage 8) to the tenth driving stage (Stage 10), so that the pixels expected to display color are able to continuously display color.

As an example, referring to FIG. 10C, the second color driving signal C may be expressed as:

{CM, CM, HI, CM}, //the sub-signal corresponding to the first driving stage (Stage 1);

{LO, LO, LO, LO}, //the sub-signal corresponding to the second driving stage (Stage 2);

{HI, LO, HI, LO}, //the sub-signal corresponding to the third driving stage (Stage 3);

{HI, LO, HI, LO}, //the sub-signal corresponding to the fourth driving stage (Stage 4);

{LO, RV, LO, RV}, //the sub-signal corresponding to the fifth driving stage (Stage 5);

{CM, CM, RV, CM}, //the sub-signal corresponding to the sixth driving stage (Stage 6);

{LO, RV, LO, RV}, //the sub-signal corresponding to the seventh driving stage (Stage 7);

{CM, CM, CM, CM}, //the sub-signal corresponding to the eighth driving stage (Stage 8);

{CM, CM, CM, CM}, //the sub-signal corresponding to the ninth driving stage (Stage 9);

{CM, CM, CM, CM}, //the sub-signal corresponding to the tenth driving stage (Stage 10).

Each row represents a cyclic unit in the sub-signal corresponding to a driving stage. That is, the cyclic unit includes the above four parts. From the above data, a voltage value of each of the four parts included in each cycle unit may be seen.

Durations of the four parts included in the cycle unit in the sub-signal of the second color driving signal C corresponding to each driving stage and the repetition number of the cycle unit, may be referred to the foregoing data on the durations of the four parts included in the cyclic unit in the sub-signal of the first color driving signal B corresponding to each driving stage and the repetition number of the cyclic unit.

Considering the sub-signal (the second color first dither sub-signal C4) of the second color driving signal C corresponding to the fourth driving stage (Stage 4) as an example, the four parts of the cyclic unit include a high level with a duration of 0x03 and a voltage value of HI, a low level with a duration of 0x04 and a voltage value of LO, a high level with a duration of 0x03 and a voltage value of HI, and a low level with a duration of 0x04 and a voltage value of LO. The cyclic unit is repeated 24 times.

The third color driving signal W will be introduced below.

In some embodiments, as shown in FIGS. 10B and 10C, the third color driving signal W (i.e., the white driving signal W) includes a plurality of sub-signals corresponding to the plurality of driving stages. In the case where the first color driving signal B includes the second particle separation sub-signal B4', the third color driving signal W includes a third color first dither sub-signal W4. A driving stage corresponding to the third color first dither sub-signal W4 and the driving stage corresponding to the second particle separation sub-signal B4' are the same driving stage, and both are the fourth driving stage (Stage 4).

The third color first dither sub-signal W4 includes seventh levels and reference levels that are alternately arranged in a time sequence. A duration of the seventh level is equal to the duration of the first level, and a duration of the reference level is equal to the duration of the second level. For example, the data of the sub-signal corresponding to the fourth driving stage (Stage 4) is {0x03, 0x04, 0x03, 0x04, 0x24}, and the third color first dither sub-signal W4 includes a seventh level with a duration of 3 unit durations, a reference level with a duration of 4 unit durations, a seventh level with a duration of 3 unit durations, and a reference level with a duration of 4 unit durations that are arranged in sequence. The seventh level is a low level, and a voltage value thereof is LO. A voltage value of the reference level is CM.

The third color first dither sub-signal W4 is configured to drive the third color charged particles to wobble. The seventh level is configured to drive the third color charged particles to move towards the side proximate to the display surface of the e-ink screen. The reference level is configured to cancel driving to the third color charged particles. The reference level has a same potential as the second electrode layer, so that the first electrode and the second electrode in the pixel have no voltage difference therebetween, and the third color charged particles in the pixel(s) are further separated by inertia. In addition, the wobbling of the third color charged particles means that the third color charged particles reciprocate in the pixel(s).

In this way, the third color first dither sub-signal W4 drives the third color charged particles to move to avoid the afterimage phenomenon at a subsequent stage.

In some embodiments, as shown in FIG. 10C, the third color driving signal W includes sub-signals corresponding to at least seven driving stages. Sub-signals corresponding to the first driving stage (Stage 1) to the seventh driving stage (Stage 7) included in the third color driving signal are sequentially a third color balance sub-signal W1, a third color third dither sub-signal W2, a third color second dither sub-signal W3, the third color first dither sub-signal W4, an electric field cancellation sub-signal W5, a third color imaging sub-signal W6, and an electric field cancellation sub-signal W7.

The third color balance sub-signal W1 is configured to make a position of the third color charged particles at an initial position. The initial position is a position of the third color charged particles in a case where the pixel expected to display the third color is not driven by the third color driving signal.

The third color third dither sub-signal W2 is configured to drive the third color charged particles to wobble. For example, the third color third dither sub-signal W2 is able to drive the white charged particles WG to wobble in advance.

The third color second dither sub-signal W3 is configured to drive the third color charged particles to continue to wobble. For example, the third color second dither sub-signal W3 is able to drive the white charged particles WG to continue to wobble.

The third color first dither sub-signal W4 is configured to drive the third color charged particles to continue to wobble. For example, the third color first dither sub-signal W4 is able to drive the white charged particles WG to continue to wobble.

The third color third dither sub-signal W2, the third color second dither sub-signal W3, and the third color first dither sub-signal W4 are able to keep the white charged particles WG moving to avoid the afterimage phenomenon. In a wobbling process of the white charged particles WG, the black charged particles BG and the color charged particles CG also wobble under the action of the above sub-signals, and are opposite to the white charged particles WG in movement direction.

The electric field cancellation sub-signal W5 is configured to cancel driving to the third color charged particles.

The third color imaging sub-signal W6 is configured to drive the third color charged particles in the pixel(s) to move towards the side proximate to the display surface of the e-ink screen, so that the pixels expected to display the third color display the third color. For example, the third color imaging sub-signal W6 is configured to drive the white charged particles WG in the pixel(s) to move towards the side proximate to the display surface of the e-ink screen, so that the pixels expected to display white display white.

The electric field cancellation sub-signal W7 is configured to cancel driving to the third color charged particles.

In some embodiments, the third color driving signal W further includes sub-signals corresponding to the eighth driving stage (Stage 8) to the tenth driving stage (Stage 10), and the sub-signals are sequentially an electric field cancellation sub-signal W8, an electric field cancellation sub-signal W9, and an electric field cancellation sub-signal W10. That is, at the eighth driving stage (Stage 8) to the tenth driving stage (Stage 10), the third color driving signal W no longer has a driving effect on the third color charged particles. The e-ink screen 1 has the bistable characteristics, and even if the electric field in the e-ink screen is cancelled, a last refreshed image may stay on the e-ink screen 1. Therefore, the white charged particles in the pixel(s) expected to display white are still in the state of the sixth driving stage (Stage 6) at the eighth driving stage (Stage 8) to the tenth driving stage (Stage 10), so that the pixels expected to display white are able to continuously display white.

As an example, referring to FIG. 10C, the third color driving signal W may be expressed as:

{HI, CM, HI, CM}, //the sub-signal corresponding to the first driving stage (Stage 1);

{HI, LO, HI, LO}, //the sub-signal corresponding to the second driving stage (Stage 2)

{HI, LO, HI, LO}, //the sub-signal corresponding to the third driving stage (Stage 3);

{LO, CM, LO, CM}, //the sub-signal corresponding to the fourth driving stage (Stage 4);

{CM, CM, CM, CM}, //the sub-signal corresponding to the fifth driving stage (Stage 5);

{LO, CM, CM, CM}, //the sub-signal corresponding to the sixth driving stage (Stage 6);

{CM, CM, CM, CM}, //the sub-signal corresponding to the seventh driving stage (Stage 7);

{CM, CM, CM, CM}, //the sub-signal corresponding to the eighth driving stage (Stage 8);

{CM, CM, CM, CM}, //the sub-signal corresponding to the ninth driving stage (Stage 9);

{CM, CM, CM, CM}, //the sub-signal corresponding to the tenth driving stage (Stage 10).

Each row represents a cyclic unit in the sub-signal corresponding to a driving stage. That is, the cyclic unit includes the above four parts. From the above data, a voltage value of each of the four parts included in each cycle unit may be seen.

Durations of the four parts included in the cycle unit in the sub-signal of the third color driving signal W corresponding to each driving stage and the repetition number of the cycle unit, may be referred to the foregoing data on the durations of the four parts included in the cyclic unit in the sub-signal of the first color driving signal B corresponding to each driving stage and the repetition number of the cyclic unit.

Considering the sub-signal (the third color first dither sub-signal W4) of the third color driving signal W corresponding to the fourth driving stage (Stage 4) as an example, the four parts of the cyclic unit include a low level with a duration of 0x03 and a voltage value of LO, a reference level with a duration of 0x04 and a voltage value of CM, a low level with a duration of 0x03 and a voltage value of LO, and a reference level with a duration of 0x04 and a voltage value of CM. The cyclic unit is repeated 24 times.

In some embodiments, in a case where colors of the image to be displayed include the first color, the second color and the third color, inputting the first color driving signal to the pixels expected to display the first color in the e-ink screen, inputting the second color driving signal to the pixels expected to display the second color in the e-ink screen, and inputting the third color driving signal to the pixels expected to display the third color in the e-ink screen, includes following steps.

At an I-th driving stage of displaying the image to be displayed, the pixels in the rows in the e-ink screen 1 are sequentially scanned. A sub-signal of the first color driving signal corresponding to the I-th driving stage is input to pixels expected to display the first color in the pixels in each scanned row, a sub-signal of the second color driving signal corresponding to the I-th driving stage is input to pixels expected to display the second color in the pixels in each scanned row, and a sub-signal of the third color driving signal corresponding to the I-th driving stage is input to pixels expected to display the third color in the pixels in each scanned row, where I is greater than or equal to 1 ($I \geq 1$). Moreover, the second color driving signal, the third color driving signal and the first color driving signal have the same number of driving stages corresponding thereto. For example, as shown in FIGS. 10A to 10C, the number of driving stages corresponding to each of the second color driving signal, the third color driving signal and the first color driving signal is 10.

In some embodiments, the display control apparatus 2 may store a first color waveform file LUT WF_B of the first color driving signal B, a second color waveform file LUT WF_C of the second color driving signal C, and a third color waveform file LUT WF_W of the third color driving signal W. A waveform file is a program used to characterize the data driving signal (the first color driving signal, the second color driving signal, or the third color driving signal) shown in FIG. 10C.

The at least one processor 21 in the display control apparatus 2 may control the source driver 24 to output a corresponding data driving signal to the pixels according to the image to be displayed stored in the at least one memory 22 and the waveform files stored in the at least one memory 22. In more detail, the first color driving signal corresponding to LUT WF_B is input to the pixels expected to display the first color according to the stored first color waveform file LUT WF_B, and the first color waveform file records a waveform of the first color driving signal. The second color driving signal corresponding to LUT WF_C is input to the pixels expected to display the second color according to the stored second color waveform file LUT WF_C, and the second color waveform file records a waveform of the second color driving signal. The third color driving signal corresponding to LUT WF_W is input to the pixels expected to display the third color according to the stored third color waveform file LUT WF_W, and the third color waveform file records a waveform of the third color driving signal.

In some embodiments, after the e-ink display apparatus is trial-produced, it is necessary to test the display effect of the trial-produced e-ink display apparatus to judge whether the imaging deviation exists, and to modify the control method of the e-ink screen. The final e-ink display apparatus may be obtained by modifying an initial program and continuously debugging until the display image of the e-ink display apparatus does not have the imaging deviation.

For example, first, the initial program is used to light up a black image. Since the e-ink display apparatus usually has the imaging deviation after half a year of use, the trial-produced e-ink display apparatus is placed in an environment with a high temperature and a high humidity (e.g., a temperature of 40° C. and a humidity of 60%) for about 240 hours to simulate a case that the e-ink display apparatus is used for a long time. A microscope is used to observe the display image to judge whether the color charged particles (i.e., the red charged particles) exist in the pixel(s) expected to display black. If so, it indicates that the display image of the trial-produced e-ink display apparatus has the imaging deviation, e.g., the phenomenon of reddish black occurs.

Next, the initial program is debugged, and it is constantly judged whether the phenomenon of reddish black occurs in the display image in a debugging process. In this process, the e-ink display apparatus may be driven by using a program corresponding to the waveform of the data driving signal shown in FIG. 10A. For the program of the waveform of the data driving signal shown in FIG. 10A, a waveform frame is modified compared with the initial program. That is, the sub-signal corresponding to the fifth driving stage (Stage) 5 is modified. The e-ink display apparatus may also be driven by using a program corresponding to the waveform of the data driving signal shown in FIG. 10B. For the program of the waveform of the data driving signal shown in FIG. 10B, waveform data are modified compared with the initial program. That is, the durations of the first level and the second level of the sub-signal corresponding to the fourth driving stage (Stage 4) are modified. The e-ink display apparatus may also be driven by using a program corresponding to the waveform of the data driving signal shown in FIG. 10C. That is, a waveform frame and waveform data of the initial program are reset. The reset initial program may be burned into the display control apparatus. The display control apparatus controls the e-ink screen to display, and judges whether the phenomenon of reddish black exists on the display image. The above debugging process and judgment process are repeated until the phenomenon of reddish black does not exist on the display image, and the debugging process is over. Thus, the e-ink display apparatus that may finally leave factory is obtained, and this e-ink display apparatus may avoid display abnormalities, and the service life thereof is prolonged.

As shown in FIG. 5, some embodiments of the present disclosure further provide the display control apparatus 2. For specific functions that may be implemented by the display control apparatus 2, reference may be made to the above embodiments, which will not be repeated here.

The display control apparatus 2 includes the source driver 24, the at least one memory 22, and the at least one processor 21.

The at least one memory 22 is configured to store the first color waveform file, and the first color waveform file records the waveform of the first color driving signal. The at least one processor 21 is configured to control the source driver 24 to input the first color driving signal B to the pixels expected to display the first color in the e-ink screen according to the first color waveform file stored in the at least one memory.

The first color driving signal B includes the plurality of sub-signals corresponding to the plurality of driving stages, and the plurality of sub-signals include the first color imaging sub-signal B6 and the particle separation sub-signal, and the particle separation sub-signal is located at at least one driving stage before the driving stage where the first color imaging sub-signal is located.

The first color imaging sub-signal B6 is configured to drive the first color charged particles in the pixel(s) to move towards the side proximate to the display surface of the e-ink screen, so that the pixels expected to display the first color display the first color.

The particle separation sub-signal is configured to drive the first color charged particles and the second color charged particles in the pixel(s) to move, and to separate the first color charged particles from the second color charged particles.

In some embodiments, the at least one memory 22 is further configured to store the second color waveform file and the third color waveform file. The second color waveform file records the waveform of the second color driving signal, and the third color waveform file records the waveform of the third color driving signal.

The at least one processor 21 is further configured to: control the source driver 24 to output the second color driving signal corresponding to the second color waveform file to the pixels expected to display the second color according to the second color waveform file stored in the at least one memory 22; and control the source driver 24 to output the third color driving signal corresponding to the third color waveform file to the pixels expected to display the third color according to the third color waveform file stored in the at least one memory 22.

Some embodiments of the present disclosure provide a computer-readable storage medium (e.g. a non-transitory computer-readable storage medium). The computer-readable storage medium stores computer program instructions. When the computer program instructions run on a processor, a computer (e.g., the e-ink display apparatus) executes one or more steps of the control method of the e-ink screen in any one of the above embodiments.

For example, the computer-readable storage medium may include, but is not limited to, a magnetic storage device (e.g., a hard disk, a floppy disk or a magnetic tape), an optical disk (e.g., a compact disk (CD), a digital versatile disk (DVD)), a smart card, and a flash memory device (e.g., an erasable programmable read-only memory (EPROM), a card, a stick or a key driver). The various computer-readable storage media described in the embodiments of the present disclosure may represent one or more devices and/or other machine-readable storage media for storing information. The term "machine-readable storage media" may include, but are not limited to, various other media capable of storing, including and/or carrying instructions and/or data.

Some embodiments of the present disclosure further provide a computer program product. The computer program product includes computer program instructions. When executed on a computer, the computer program instructions enable the computer to execute one or more steps of the control method of the e-ink screen in the above embodiments.

Some embodiments of the present disclosure further provide a computer program. When executed on a computer, the computer program enables the computer to execute one or more steps of the control method of the e-ink screen in the above embodiments.

Beneficial effects of the computer-readable storage medium, the computer program product, and the computer program are same as those of the control method of the e-ink screen in some embodiments as described above, which will not be repeated here.

The foregoing descriptions are merely specific implementations of the present disclosure, but the protection scope of the present disclosure is not limited thereto. Changes or replacements that any person skilled in the art could conceive of within the technical scope of the present disclosure should be included in the protection scope of the present disclosure. Therefore, the protection scope of the present disclosure shall be subject to the protection scope of the claims.

What is claimed is:

1. A control method of an electronic ink screen, the electronic ink screen including a plurality of pixels, at least one pixel including first color charged particles and second color charged particles, the first color charged particles and the second color charged particles being same in electrical property, the control method of the electronic ink screen comprising:

inputting a first color driving signal to pixels expected to display a first color in the electronic ink screen, wherein the first color driving signal includes a plurality of sub-signals corresponding to a plurality of driving stages, the plurality of sub-signals include a first color imaging sub-signal and a particle separation sub-signal, and at least one driving stage corresponding to the particle separation sub-signal is at least one driving stage before a driving stage corresponding to the first color imaging sub-signal;

the first color imaging sub-signal is configured to drive the first color charged particles in the at least one pixel to move towards a side proximate to a display surface of the electronic ink screen, so that the pixels expected to display the first color display the first color;

the particle separation sub-signal is configured to drive the first color charged particles and the second color charged particles in the at least one pixel to move, and to separate the first color charged particles from the second color charged particles; and the particle separation sub-signal includes a first particle separation sub-signal and a second particle separation sub-signal, a driving stage corresponding to the first particle separation sub-signal precedes the driving stage corresponding to the first color imaging sub-signal, and a driving stage corresponding to the second particle separation sub-signal precedes the driving stage corresponding to the first particle separation sub-signal;

the first particle separation sub-signal is a first color push-down signal configured to drive the first color charged particles and the second color charged particles to move towards a side away from the display surface of the electronic ink screen and separate the first color charged particles from the second color charged particles;

the second particle separation sub-signal is a first color first dither sub-signal including first levels and second levels that are alternately arranged in a time sequence;

the second particle separation sub-signal is configured to drive the first color charged particles and the second color charged particles to wobble, wherein a first level in the first levels is configured to drive the first color charged particles and the second color charged particles to move towards the side proximate to the display surface of the electronic ink screen, and a second level in the second levels is configured to drive the first color charged particles and the second color charged particles to move towards the side away from the display surface of the electronic ink screen; and a duration of the first level is less than a duration of the second level.

2. The control method according to claim 1, wherein the plurality of sub-signals included in the first color driving signal further include a first color balance sub-signal, and a driving stage corresponding to the first color balance sub-signal is a first driving stage in the plurality of driving stages;

the first color balance sub-signal is configured to make a position of the first color charged particles at an initial position, wherein the initial position is a position of the first color charged particles in a case where the pixels expected to display the first color are not driven by the first color driving signal.

3. The control method according to claim 2, wherein the first color balance sub-signal includes a reference level, a third level, a fourth level and a reference level that are sequentially arranged;

a level polarity of the third level is opposite to a level polarity of the first color imaging sub-signal;

a level polarity of the fourth level is opposite to a level polarity of the first particle separation sub-signal; and the level polarity of the fourth level is opposite to a level polarity of the second level.

4. The control method according to claim 1, wherein the first color driving signal includes sub-signals corresponding to at least seven driving stages, wherein sub-signals corresponding to a first driving stage to a seventh driving stage included in the first color driving signal are sequentially:

a first color balance sub-signal configured to make a position of the first color charged particles at an initial position, wherein the initial position is a position of the first color charged particles in a case where the pixels expected to display the first color are not driven by the first color driving signal;

a first color second dither sub-signal configured to drive the first color charged particles to wobble;

a first color third dither sub-signal configured to drive the first color charged particles to continue to wobble;

a first color first dither sub-signal configured to drive the first color charged particles and the second color charged particles to wobble and separate the first color charged particles from the second color charged particles;

a first color push-down sub-signal configured to drive the first color charged particles and the second color charged particles to move towards a side away from the display surface of the electronic ink screen and separate the first color charged particles from the second color charged particles;

the first color imaging sub-signal; and an electric field cancellation sub-signal configured to cancel driving to the first color charged particles.

5. The control method according to claim 1, further comprising:

inputting a second color driving signal to pixels expected to display a second color in the electronic ink screen, wherein the second color driving signal includes a plurality of sub-signals corresponding to the plurality of driving stages;

the second color driving signal includes a second color first dither sub-signal, and a driving stage corresponding to the second color first dither sub-signal and a driving stage corresponding to the second particle separation sub-signal are a same driving stage;

the second color first dither sub-signal includes fifth levels and sixth levels that are alternately arranged in a time sequence;

the second color first dither sub-signal is configured to drive the first color charged particles and the second color charged particles to wobble, wherein a fifth level in the fifth levels is configured to drive the first color charged particles and the second color charged particles to move towards the side proximate to the display surface of the electronic ink screen, and a sixth level in the sixth levels is configured to drive the first color charged particles and the second color charged particles to move towards a side away from the display surface of the electronic ink screen; and a duration of the fifth level is equal to the duration of the first level, and a duration of the sixth level is equal to the duration of the second level.

6. The control method according to claim 5, wherein the second color driving signal includes sub-signals corresponding to at least seven driving stages, wherein sub-signals corresponding to a first driving stage to a seventh driving stage included in the second color driving signal are sequentially:

a second color inversion sub-signal configured to drive the second color charged particles to invert;

a second color balance sub-signal configured to make a position of the second color charged particles at an initial position, wherein the initial position is a position of the second color charged particles in a case where the pixels expected to display the second color are not driven by the second color driving signal;

a second color second dither sub-signal configured to drive the second color charged particles to wobble;

the second color first dither sub-signal configured to drive the second color charged particles to continue to wobble;

a second color pre-imaging sub-signal configured to drive the second color charged particles in the at least one pixel to move towards the side proximate to the display surface of the electronic ink screen;

a second color push-up sub-signal configured to drive the second color charged particles in the at least one pixel to move towards the side proximate to the display surface of the electronic ink screen; and a second color imaging sub-signal configured to drive the second color charged particles in the at least one pixel to move towards the side proximate to the display surface of the electronic ink screen, so that the pixels expected to display the second color display the second color.

7. The control method according to claim 1, wherein the at least one pixel further includes third color charged particles, and the third color charged particles are opposite to the first color charged particles in electrical property;

the control method further comprises: inputting a third color driving signal to pixels expected to display a third color in the electronic ink screen;

the third color driving signal includes a third color first dither sub-signal, and a driving stage corresponding to the third color first dither sub-signal and a driving stage corresponding to the second particle separation sub-signal are a same driving stage;

the third color first dither sub-signal includes seventh levels and reference levels that are alternately arranged in a time sequence;

the third color first dither sub-signal is configured to drive the third color charged particles to wobble, wherein a seventh level in the seventh levels is configured to drive the third color charged particles to move towards the side proximate to the display surface of the electronic ink screen, and a reference level in the reference levels is configured to cancel driving to the third color charged particles; and a duration of the seventh level is equal to the duration of the first level, and a duration of the reference level is equal to the duration of the second level.

8. The control method according to claim 7, wherein the third color driving signal includes sub-signals corresponding to at least seven driving stages, wherein sub-signals corresponding to a first driving stage to a seventh driving stage included in the third color driving signal are sequentially:

a third color balance sub-signal configured to make a position of the third color charged particles at an initial position, wherein the initial position is a position of the third color charged particles in a case where the pixels expected to display the third color are not driven by the third color driving signal;

a third color third dither sub-signal configured to drive the third color charged particles to wobble;

a third color second dither sub-signal configured to drive the third color charged particles to continue to wobble;

the third color first dither sub-signal configured to drive the third color charged particles to continue to wobble;

an electric field cancellation sub-signal configured to cancel driving to the third color charged particles;

a third color imaging sub-signal configured to drive the third color charged particles in the at least one pixel to move towards the side proximate to the display surface of the electronic ink screen, so that the pixels expected to display the third color display the third color; and an electric field cancellation sub-signal configured to cancel driving to the third color charged particles.

9. The control method according to claim 1, wherein colors of an image to be displayed include the first color, a second color, and a third color, and inputting the first color driving signal to the pixels expected to display the first color in the electronic ink screen, inputting a second color driving signal to pixels expected to display a second color in the electronic ink screen, and inputting a third color driving signal to pixels expected to display a third color in the electronic ink screen, includes:

sequentially scanning pixels in rows in the electronic ink screen at an I-th driving stage of displaying the image to be displayed; and inputting a sub-signal of the first color driving signal corresponding to the I-th driving stage to pixels expected to display the first color in pixels in each scanned row, inputting a sub-signal of the second color driving signal corresponding to the I-th driving stage to pixels expected to display the second color in pixels in each scanned row, inputting a sub-signal of the third color driving signal corresponding to the I-th driving stage to pixels expected to display the third color in pixels in each scanned row, wherein I is greater than or equal to 1, and the first color driving signal, the second color driving signal and the third color driving signal have a same number of driving stages corresponding thereto.

10. A display control apparatus, comprising:

a source driver;

at least one memory configured to store a first color waveform file, the first color waveform file recording a waveform of a first color driving signal; and at least one processor configured to control the source driver to input the first color driving signal to pixels expected to display a first color in an electronic ink screen according to the first color waveform file stored in the at least one memory, wherein the first color driving signal includes a plurality of sub-signals corresponding to a plurality of driving stages, the plurality of sub-signals include a first color imaging sub-signal and a particle separation sub-signal, and the particle separation sub-signal is located at at least one driving stage before a driving stage where the first color imaging sub-signal is located;

the first color imaging sub-signal is configured to drive first color charged particles in a pixel to move towards a side proximate to a display surface of the electronic ink screen, so that the pixels expected to display the first color display the first color;

the particle separation sub-signal is configured to drive the first color charged particles and second color charged particles in the pixel to move, and to separate the first color charged particles from the second color charged particles; and the particle separation sub-signal includes a first particle separation sub-signal and a second particle separation sub-signal, a driving stage corresponding to the first particle separation sub-signal precedes a driving stage corresponding to the first color imaging sub-signal, and a driving stage corresponding to the second particle separation sub-signal precedes the driving stage corresponding to the first particle separation sub-signal;

the first particle separation sub-signal is a first color push-down signal configured to drive the first color charged particles and the second color charged particles to move towards a side away from the display surface of the electronic ink screen and separate the first color charged particles from the second color charged particles;

the second particle separation sub-signal is a first color first dither sub-signal including first levels and second levels that are alternately arranged in a time sequence;

the second particle separation sub-signal is configured to drive the first color charged particles and the second color charged particles to wobble, wherein a first level in the first levels is configured to drive the first color charged particles and the second color charged particles to move towards the side proximate to the display surface of the electronic ink screen, and a second level in the second levels is configured to drive the first color charged particles and the second color charged particles to move towards the side away from the display surface of the electronic ink screen; and a duration of the first level is less than a duration of the second level.

11. The display control apparatus according to claim 10, wherein the at least one processor is further configured to store a second color waveform file and a third color waveform file, wherein the second color waveform file records a waveform of a second color driving signal, and the third color waveform file records a waveform of a third color driving signal;

the at least one processor is further configured to: control the source driver to output the second color driving signal corresponding to the second color waveform file to pixels expected to display a second color according to the second color waveform file stored in the at least one memory; and control the source driver to output the third color driving signal corresponding to the third color waveform file to pixels expected to display a third color according to the third color waveform file stored in the at least one memory.

12. An electronic ink display apparatus, comprising:

an electronic ink screen including a plurality of pixels, at least one pixel including first color charged particles and second color charged particles, and the first color charged particles and the second color charged particles being same in electrical property; and a display control apparatus coupled to the electronic ink screen, the display control apparatus being the display control apparatus according to claim 10.

13. The electronic ink display apparatus according to claim 12, wherein a charge amount of the first color charged particles is greater than a charge amount of the second color charged particles.

14. A non-transitory computer-readable storage medium storing computer program instructions, when the computer program instructions run on an electronic ink display apparatus, the electronic ink display apparatus executing the control method of the electronic ink screen according to claim 1.

* * * * *